US012668978B2

(12) United States Patent
LeVan

(10) Patent No.: US 12,668,978 B2
(45) Date of Patent: Jun. 30, 2026

(54) BUILDING FAÇADE CONSTRUCTED OF CURTAIN WALL PANELS INCLUDING FIRE-SAFING INSULATION AND METHOD OF INSTALLATION

(71) Applicant: Talon Wall Holdings, LLC, South Holland, IL (US)

(72) Inventor: Kurtis E LeVan, South Holland, IL (US)

(73) Assignee: Talon Wall Holdings, LLC, IL (US)

( * ) Notice: Subject to any disclaimer, the term of this patent is extended or adjusted under 35 U.S.C. 154(b) by 247 days.

(21) Appl. No.: 18/383,243

(22) Filed: Oct. 24, 2023

(65) Prior Publication Data

US 2024/0133185 A1 Apr. 25, 2024
US 2024/0229471 A9 Jul. 11, 2024

Related U.S. Application Data

(60) Provisional application No. 63/419,181, filed on Oct. 25, 2022.

(51) Int. Cl.
*E04B 1/00* (2006.01)
*E04F 13/08* (2006.01)
*E04F 13/21* (2006.01)

(52) U.S. Cl.
CPC ..... *E04F 13/0866* (2013.01); *E04F 13/0887* (2013.01); *E04F 13/21* (2013.01)

(58) Field of Classification Search
CPC .. E04F 13/0866; E04F 13/0887; E04B 1/947; E04B 2/967
See application file for complete search history.

(56) References Cited

U.S. PATENT DOCUMENTS 3,786,604 A 1/1974 Kramer
4,449,341 A 5/1984 Taglianetti et al.
7,424,793 B1 * 9/2008 Shriver ..... E04B 2/88 52/235
7,644,549 B2 1/2010 Speck
(Continued)

OTHER PUBLICATIONS

International Search Report in related PCT/US23/035811.
Written Opinion of the International Search Authority in related PCT/US23/035811.

*Primary Examiner* — Basil S Katcheves
(74) *Attorney, Agent, or Firm* — George Pappas; Barrett McNagny LLP

(57) ABSTRACT

A building façade secured to a building structure having a plurality of floor levels can comprise a plurality of façade panels wherein one or more façade panels include a strip of fire-safing insulation. The façade panels can be secured to the building structure adjacent an edge of a floor with the strip of fire-safing insulation engaging the floor edge along a vertical surface and a horizontal surface of the floor. Additionally, a method of installing a façade on a building structure can comprise the steps of: providing a plurality of façade panels, wherein the façade panels include a strip of fire-safing insulation, hanging the façade panels on the building floors adjacent an edge thereof, during the step of hanging, traversing the strip of fire-safing insulation vertically downwardly and horizontally towards the floor edge, and sandwiching the strip of fire-safing insulation between the façade panels and the floor edge.

15 Claims, 20 Drawing Sheets

(56) References Cited

U.S. PATENT DOCUMENTS 8,001,738 B2 8/2011 Ting
8,671,645 B1 3/2014 Shriver
8,959,855 B2 2/2015 Evensen
9,016,014 B2 4/2015 Shriver
9,752,319 B1 9/2017 LeVan
9,869,086 B2 1/2018 Andresen
10,017,939 B2 7/2018 Andresen
10,094,111 B2 10/2018 LeVan
10,138,629 B2 11/2018 Schulz-Hanke et al.
10,202,759 B2 2/2019 Andresen et al.
10,202,764 B2 2/2019 LeVan
10,233,638 B2 3/2019 LeVan
10,309,100 B2 6/2019 Long et al.
10,415,239 B2 9/2019 Schulz-Hanke et al.
10,519,653 B2 12/2019 Schulz-Hanke et al.
10,538,915 B1 * 1/2020 Zemler ..... E04B 2/92
10,648,172 B2 5/2020 Andresen et al.
10,669,709 B2 6/2020 Zemler et al.
10,724,234 B2 7/2020 LeVan
11,002,007 B2 5/2021 Zemler et al.
11,035,121 B2 6/2021 Klein et al.
11,078,664 B1 8/2021 Wigboldy et al.
11,091,908 B2 8/2021 Paetow et al.
11,124,962 B2 9/2021 Andresen et al.
11,339,566 B2 5/2022 Zemler et al.
11,492,799 B2 * 11/2022 Zemler ..... E04B 1/7675
2007/0204540 A1 * 9/2007 Stahl ..... E04B 5/00 52/274
2009/0126297 A1 * 5/2009 Stahl, Jr. ..... E04B 2/88 52/235
2010/0107532 A1 * 5/2010 Shriver ..... E04B 1/947 52/489.1
2013/0061544 A1 * 3/2013 Stahl, Jr. ..... E04B 2/96 52/235
2013/0097948 A1 * 4/2013 Burgess ..... E04B 2/7409 52/232
2014/0137494 A1 * 5/2014 Stahl, Jr. ..... E04B 2/88 52/235
2014/0202721 A1 * 7/2014 Shaw ..... E06B 5/164 169/48
2014/0311067 A1 * 10/2014 Criaud ..... E04B 2/965 52/235
2014/0318068 A1 * 10/2014 Jakobsen ..... E04B 1/762 52/506.05
2014/0345215 A1 * 11/2014 Magoon ..... E04B 2/90 52/235
2015/0040493 A1 * 2/2015 Kuo ..... E04B 2/44 52/745.1
2015/0052840 A1 * 2/2015 Beaty ..... E04B 2/58 52/745.1
2015/0059269 A1 * 3/2015 Ting ..... E04B 2/88 52/745.12
2015/0135615 A1 5/2015 Hogan et al.
2016/0356034 A1 * 12/2016 Andresen ..... E04B 2/88
2017/0284085 A1 10/2017 Ting
2018/0334799 A1 * 11/2018 Andresen ..... E04B 1/948
2019/0063064 A1 * 2/2019 Paetow ..... E04B 1/948
2019/0093349 A1 * 3/2019 LeVan ..... E04B 2/885
2019/0284798 A1 * 9/2019 Klein ..... E04B 1/948
2020/0291644 A1 * 9/2020 Ober ..... E04B 1/82
2020/0325678 A1 * 10/2020 Zemler ..... E04B 2/7411

* cited by examiner

FIG. 4A
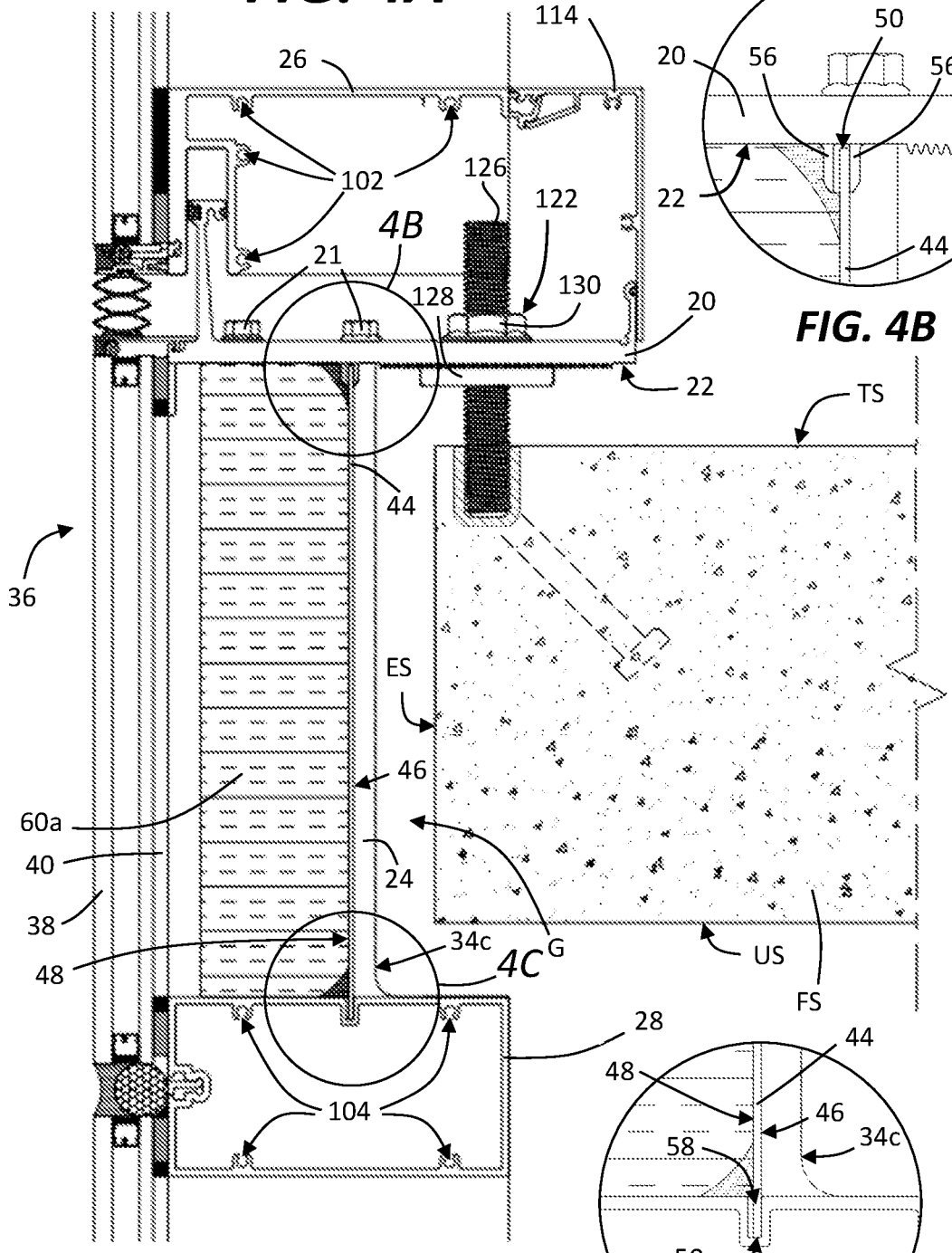
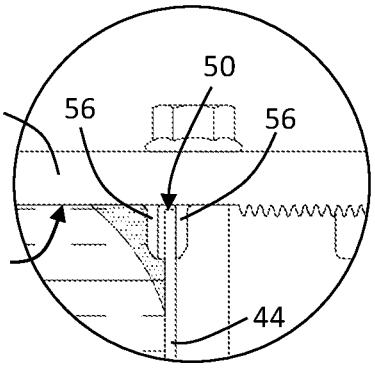
FIG. 4B
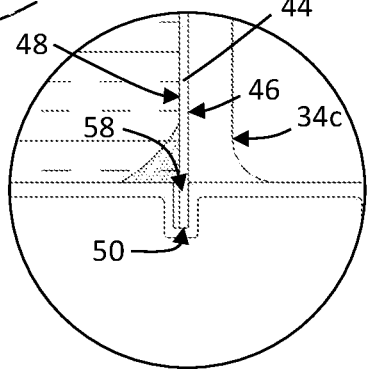
FIG. 4C

BUILDING FAÇADE CONSTRUCTED OF CURTAIN WALL PANELS INCLUDING FIRE-SAFING INSULATION AND METHOD OF INSTALLATION

CROSS REFERENCE TO RELATED APPLICATIONS

This application claims priority under 35 U.S.C. 119(e) of U.S. provisional patent application Ser. No. 63/419,181 filed on Oct. 25, 2022, entitled Curtain Wall Panels Including Fire Safing Insulation and Method of Installation, the disclosure of which is hereby incorporated herein by reference.

INCORPORATION BY REFERENCE

The specifications, drawings, and claims of LeVan, U.S. Pat. No. 10,724,234; LeVan, U.S. Pat. No. 10,202,764; LeVan, U.S. Pat. No. 9,752,319; LeVan, U.S. Pat. No. 10,094,111; and, LeVan, U.S. Pat. No. 10,233,638 (collectively, the "LeVan Patents") are hereby incorporated by reference in their entirety.

BACKGROUND OF THE INVENTION

1. Field of the Invention

The present invention relates to the field of façade systems which form a curtain wall or shell around buildings. More particularly, the present invention relates to building façade curtain wall panels and methods of incorporating/installing fire-safing insulation in the building façade curtain wall between successive floors of the building.

2. Background

Building façade systems are known and are common. They form a curtain wall around buildings and protect the building from the elements. The curtain wall typically comprises a plurality of panels supported on a framework, typically referred to as "façade panels" or "curtain panels", which are hung and/or otherwise secured to the building structure. The panels and framework can be made of various materials such as glass, stone, steel, aluminum, etc., and can be various sizes as needed or desired. The panels can also be insulated. Different types of panels can be used such as, for example, transparent glass between the floor slabs and opaque glass or stone along the building structural components.

Traditional curtain wall façade systems are hung and/or are secured to the building structure outside of the terminal edges of the building floor slabs such that there is a gap, also known as a "safing slot", between the curtain wall and each slab terminal edge. To prevent transmission of smoke and fire between the building floors, noncombustible fire-safing insulation, such as, for example, stone wool, mineral wool, etc., is installed, and indeed is required by building codes to be installed, in the gap/safing slot between the curtain wall and the terminal edges of the slabs. Smoke sealant can also be applied over the fire-safing insulation.

Of course, the fire-safing insulation must be field installed in the gap/safing slot after the curtain panels are installed—after the gap is established by the installation of the curtain panels at a distance from the slab edges—which can be difficult, time consuming and costly, particularly when the gaps/safing slots are hidden beneath structural elements of the curtain wall or access is otherwise obscured by structural components of the building. Traditional curtain wall façade systems which require fire-safing insulation are shown and described, for example, in Kramer U.S. Pat. No. 3,786,604 ("Kramer"); Shriver, U.S. Pat. No. 8,671,645 ("Shriver"); and, Hogan et al. US 2015/0135615 ("Hogan").

Hybrid curtain wall façade systems, also sometimes referred to as "window walls with slab edge covers" are hung and/or are secured to the building structure such that they envelop and/or sandwich the terminal edge of the slabs so that there is no gap/safing slot. These curtain wall systems inherently prevent the transmission of smoke and fire between floors because they envelop/sandwich the slab and, hence, building codes do not require the installation of fire-sating insulation therewith. Hybrid curtain wall façade systems which are inherently fire safe and do not require fire-sating insulation are, for example, shown and described in the LeVan Patents, Evensen et al., U.S. Pat. No. 8,959,855 ("Evensen"); Ting, U.S. Pat. No. 8,001,738 ("Ting"); and, Speck, U.S. Pat. No. 7,644,549 ("Speck").

Although the hybrid curtain wall façade systems are fire safe and building codes do not require fire-safing insulation to be installed therewith, some building owners nevertheless desire yet more fire safety, beyond that required by the building codes. For achieving the sometimes desired yet greater fire safety, it has been proposed to add fire-safing insulation to the hybrid curtain wall façade systems. However, similar to the traditional curtain wall façade systems, the installation of fire-safing insulation in hybrid curtain wall façade systems would be inefficient, time consuming and costly.

Accordingly, a need exists for an improved, more efficient, and cost-effective method of installing fire-sating insulation in curtain wall façade systems.

SUMMARY OF THE INVENTION

In one embodiment of the present invention, a method of installing a façade on a building structure having a plurality of vertically stacked levels defined by horizontally arranged floors therebetween comprises the steps of: providing a plurality of façade panels, wherein one of more of the façade panels includes a strip of fire-safing insulation, hanging the one or more façade panels on the one or more building floors adjacent an edge thereof, during the step of hanging, traversing the strip of fire-safing insulation vertically downwardly and horizontally towards the floor edge, and sandwiching at least a portion of the strip of fire-safing insulation between the one or more façade panels and the floor edge.

Preferably, after the step of hanging, the strip of fire-safing insulation engages the floor edge along a vertical surface and a horizontal surface of the floor. Yet more preferably, during the step of hanging one or more façade panels, one or more strips of adjacently hung façade panels engage each other and thereby form a continuous strip of fire-safing insulation between the adjacently hung façade panels and the floor edge.

Preferably, prior to the step of hanging, the strip of fire-safing insulation is secured to the one or more façade panels. Yet more preferably, the step of securing comprises the steps of piercing the strip of fire-safing insulation with an impaling pin and attaching the impaling pin to the one or more façade panels.

Preferably, during the step of attaching the impaling pin to the one or more façade panels, a surface of the impaling pin is adhered to the one or more façade panels and/or the impaling pin is fastened to the one or more façade panels with a fastener. Yet more preferably, the step of securing comprises the step of adhering the strip of fire-safing insulation to the one or more façade panels with a noncombustible adhesive.

Preferably, during the step of hanging, at least a portion of the strip of fire-safing insulation compresses and the impaling pin bends.

Preferably, the one of more of the façade panels further includes a shelf member extending therefrom and defining a corner therebetween. The strip of fire-safing insulation can be provided substantially in the corner and, during the step of hanging, a portion of the shelf member can be placed over the floor edge and sandwiching at least a portion of the strip of fire-safing insulation between the one or more façade panels and a vertical surface of the floor and between the shelf member and a horizontal surface of the floor.

Preferably, a noncombustible sealant can be provided between the shelf member and the horizontal surface of the floor.

Preferably, gaps are formed between shelf members of adjacently located façade panels and the gaps can be sealed with a noncombustible sealer and/or a noncombustible sealing strip.

Preferably, one or more panel position adjusting mechanisms operatively engage the shelf member and, during the step of hanging, the vertical and/or horizontal position of the one or more façade panels can be adjusted relative to the floor.

Preferably, prior to or during the step of providing a plurality of façade panels, one of more of the façade panels and the strip of fire-safing insulation can be wrapped with a protective sheeting material and, prior to the step of hanging, the protective sheeting material can be removed from the one of more of the façade panels and the strip of fire-safing insulation.

In another embodiment of the present invention, a building façade secured to a building structure having a plurality of vertically stacked levels defined by horizontally arranged floors therebetween comprises a plurality of façade panels wherein one or more of the façade panels comprise a strip of fire-safing insulation. One or more of the façade panels can be secured to the building structure adjacent an edge of a floor thereof and the strip of fire-safing insulation engages the floor edge along a vertical surface and a horizontal surface of the floor.

Preferably, one or more of the façade panels further comprise a shelf member extending therefrom and defining a corner therebetween, and the strip of fire-safing insulation can be provided substantially in the corner. Yet more preferably, a portion of the strip of fire-safing insulation can be sandwiched between the one or more façade panels and the vertical surface of the floor and a portion of the strip of fire-safing insulation is sandwiched between the shelf member and the horizontal surface of the floor.

BRIEF DESCRIPTION OF THE DRAWINGS

The above-mentioned and other features of this invention and the manner of attaining them will become more apparent, and the invention itself will be better understood by reference to the following description of the embodiments of the invention, taken in conjunction with the accompanying drawings, wherein:

FIG. 4A is a cross section view of the framework shown in FIG. 2 taken along line 4-4 and wherein the fire-safing insulation, the impaling pins, the backer rods, and the sealant have been removed for clarity;

FIG. 4B is a magnified detail view of Circled Detail 4B shown in FIG. 4A;

FIG. 4C is a magnified detail view of Circled Detail 4C shown in FIG. 4A;

Figure 1:
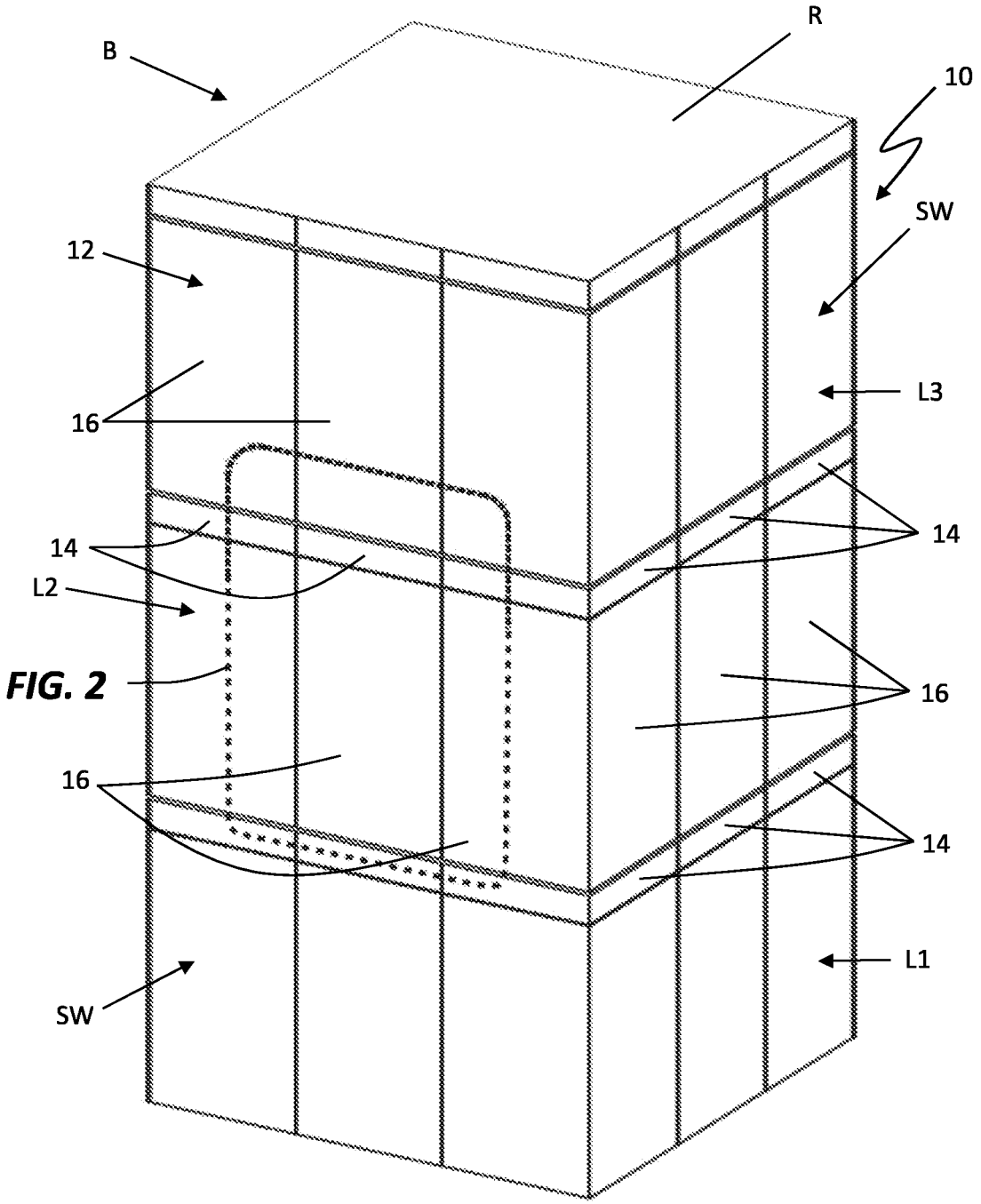
FIG. 1 is a diagrammatic perspective view of a façade system constructed in accordance with the principles of the present invention on a building.

Corresponding reference characters indicate corresponding parts throughout several views. Although the exemplification set out herein illustrates certain embodiments of the invention, the embodiments disclosed below are not intended to be exhaustive or to be construed as limiting the scope of the invention to the precise form disclosed.

DETAILED DESCRIPTION OF THE PREFERRED EMBODIMENTS

Referring initially to FIG. 1, a building façade system constructed in accordance with the principles of the present invention is generally designated by the numeral 10 and is installed on a building B. Building B includes a roof R and multiple side walls SW. Building B can, of course, be arranged in a wide variety of shapes and include any number of side walls SW. Building B can further comprise any number of floors or levels as needed or architecturally desired.

Building B is diagrammatically depicted and is shown having three levels LI, L2, and L3. Concrete and/or steel and concrete floor slabs FS are constructed and supported between each of the levels LI, L2, L3 in a known and customary manner. The floor slabs FS each include a top surface TS, an underside surface US, and a terminal edge surface ES. The terminal edge surfaces ES of each floor slab FS are generally coplanar with one another.

The facade system 10 is secured to the floor slabs FS and forms an outer curtain wall or shell which is architecturally aesthetically pleasing. The facade system 10 additionally protects the building from the elements. The curtain wall/shell is formed from a plurality of façade/curtain panels 12 which are installed on a building structure side-by-side/adjacent one another and which together form the shell or façade of the building. Although preferred embodiments of the façade/curtain panels 12 are described and illustrated, it should be understood that "curtain panels" or "façade panels" as used herein includes any panels which are installed on a building structure side-by-side/adjacent one another and which together form the shell or façade of the building.

The curtain panels 12 can include a plurality of slab edge cover panels 14 extending along and generally covering the floor slab terminal edge surfaces ES. The curtain panels 12 can also include a plurality of infill panels 16 extending between the slab edge cover panels 14 and enclosing the building interior space at each level L1, L2, and L3 between successive floor slabs FS.

The slab edge cover panels 14 and the infill panels 16 can be made of glass which can be transparent, opaque, tinted, translucent, etc. They can also be made from stone, steel, metal, aluminum, and other materials as needed or desired and can be insulated as needed or desired. The slab edge cover panels 14 and the infill panels 16 can also comprise many different dimensions, layers, and thicknesses as needed or desired.

Figure 2:
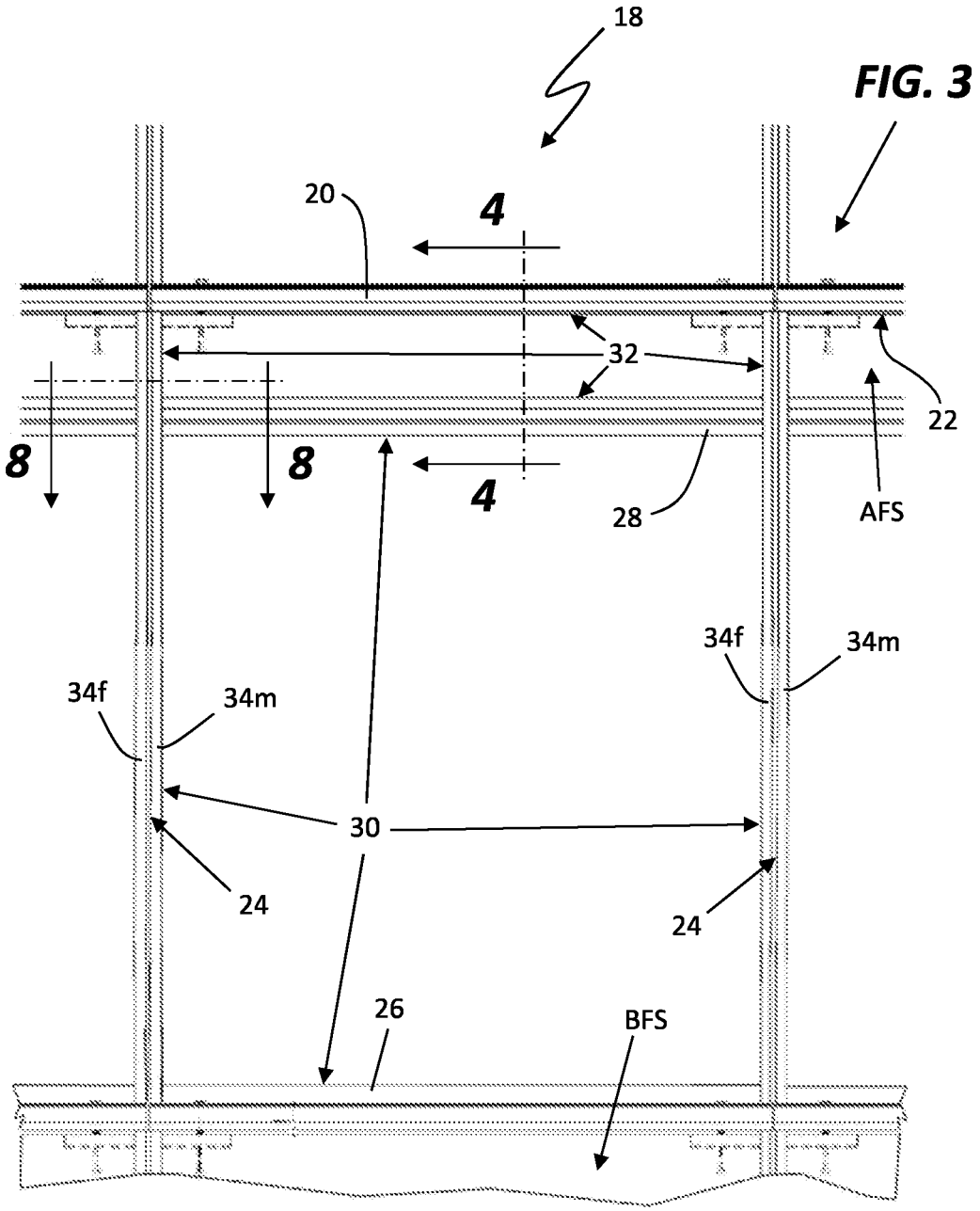
FIG. 2 is a partial side elevation view of the framework of the façade system shown in FIG. 1 and wherein the infill panels, the edge cover panels and the horizontal infill support members on the above floor slab have been removed for clarity.
Figure 3:
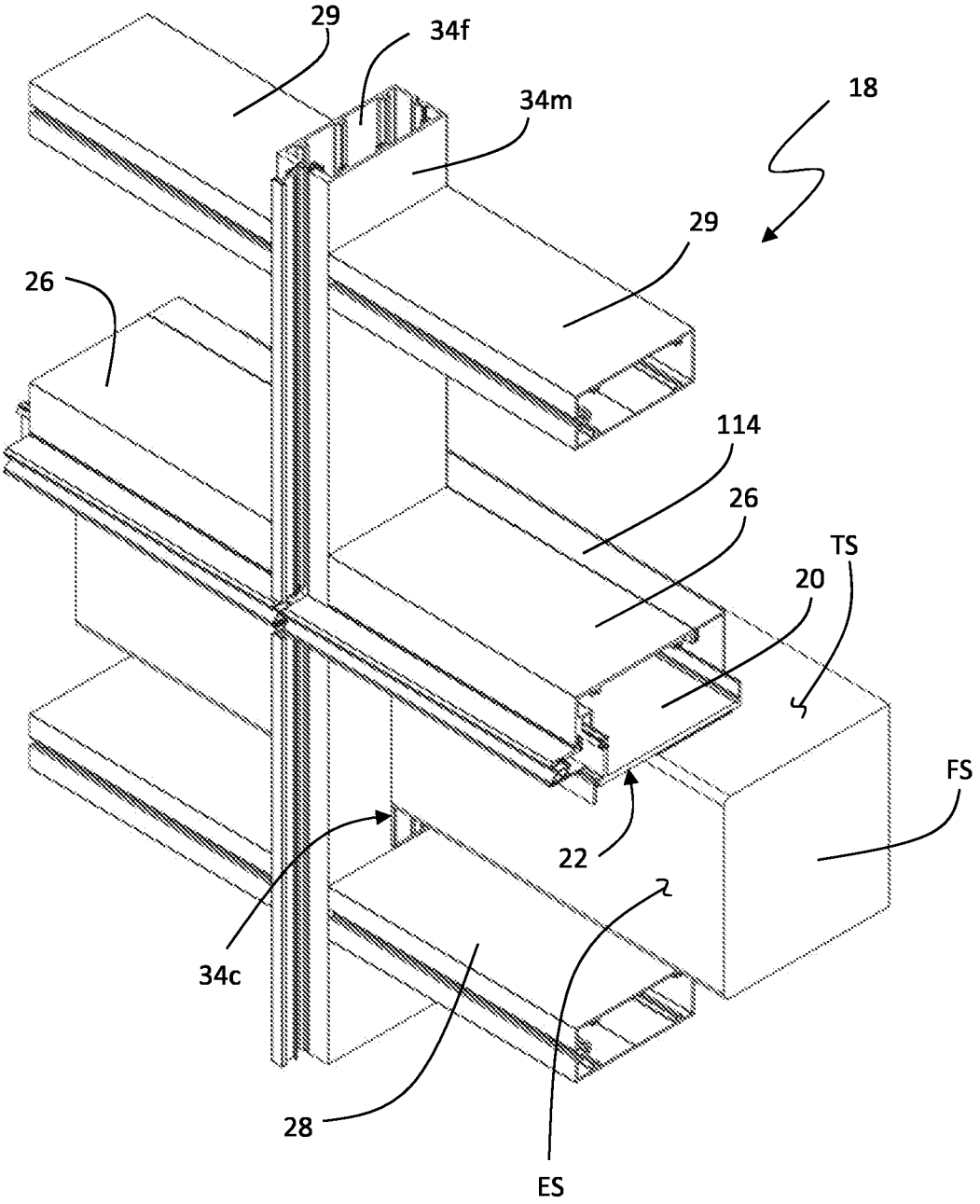
FIG. 3 is a partial perspective view from above of the framework shown in FIG. 2.
Figures 5A, 5B:
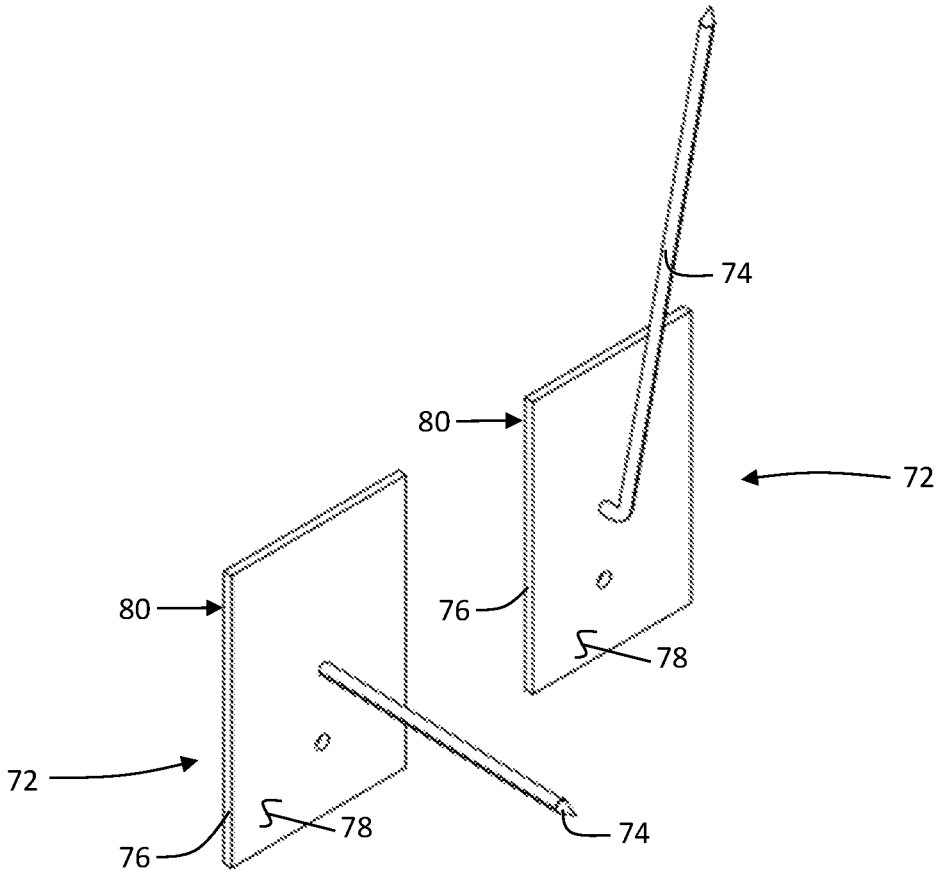
FIG. 5A is a perspective view of an impaling pin before it has been prepared for installation.
FIG. 5B is a perspective view of the impaling pin shown in FIG. 5A after it has been prepared for installation.

As best seen in FIGS. 2 and 3, the slab edge cover panels 14 and the infill panels 16 are supported on a framework 18 which is secured to a floor slab FS. The framework 18 functions to, for each building level L1, L2, L3, hang the slab edge cover panels 14 and the infill panels 16 of that building level from the floor slab FS thereabove. For clarity and reference in this regard, as depicted in FIG. 2, for any level L1, L2, L3, the floor slab below the floor slab which supports that level is herein referred to as the "below" floor slab BFS, and the floor slab directly above that level is referred to as the "above" floor slab AFS.

The framework 18 includes horizontal shelf members 20 secured to the above floor slabs AFS above the top surfaces TS thereof. The shelf members 20 include bottom shelf surfaces 22 facing the floor slab top surfaces TS. Vertical mullions 24 are securely fastened to the horizontal shelf members 20 located on the above floor slab AFS and extend vertically downwardly therefrom toward the below floor slab BFS. Horizontal infill support members 26 extend between, and are securely fastened to, the lower terminal ends of adjacent pairs of vertical mullions 24. The infill support members 26 are coupled to the horizontal shelf members 20 which are secured to the below floor slab BFS. The infill support members 26 and the horizontal shelf members 20 secured to the below floor slab BFS are coupled in a manner whereby they are moveable vertically, but not horizontally, relative to each other.

Continuous L-shaped sill trim covers 114 can be secured to the infill support members 26 for closing off easy access to the components used for mounting the horizontal shelf members 20 secured to the below floor slab BFS. The sill trim covers 114 are slidingly supported along the horizontal shelf members 20 whereby they are moveable vertically, but not horizontally, relative to each other.

Intermediate horizontal edge cover support members 28 are located vertically between the infill support members 26 and the shelf members 20 and extend between and are securely fastened to adjacent pairs of vertical mullions 24. Accordingly, a plurality of rectangular infill frames 30 are formed and defined between the adjacent pairs of vertical mullions 24, the infill support members 26, and the edge cover support members 28. The infill panels 16 are sized to fit within and be adhered to the rectangular infill frames 30. More particularly, the infill panels 16 are supported on the infill support members 26 and are adhered along their perimeter edges to the adjacent pairs of vertical mullions 24, the infill support members 26, and the edge cover support members 28.

Figure 15:
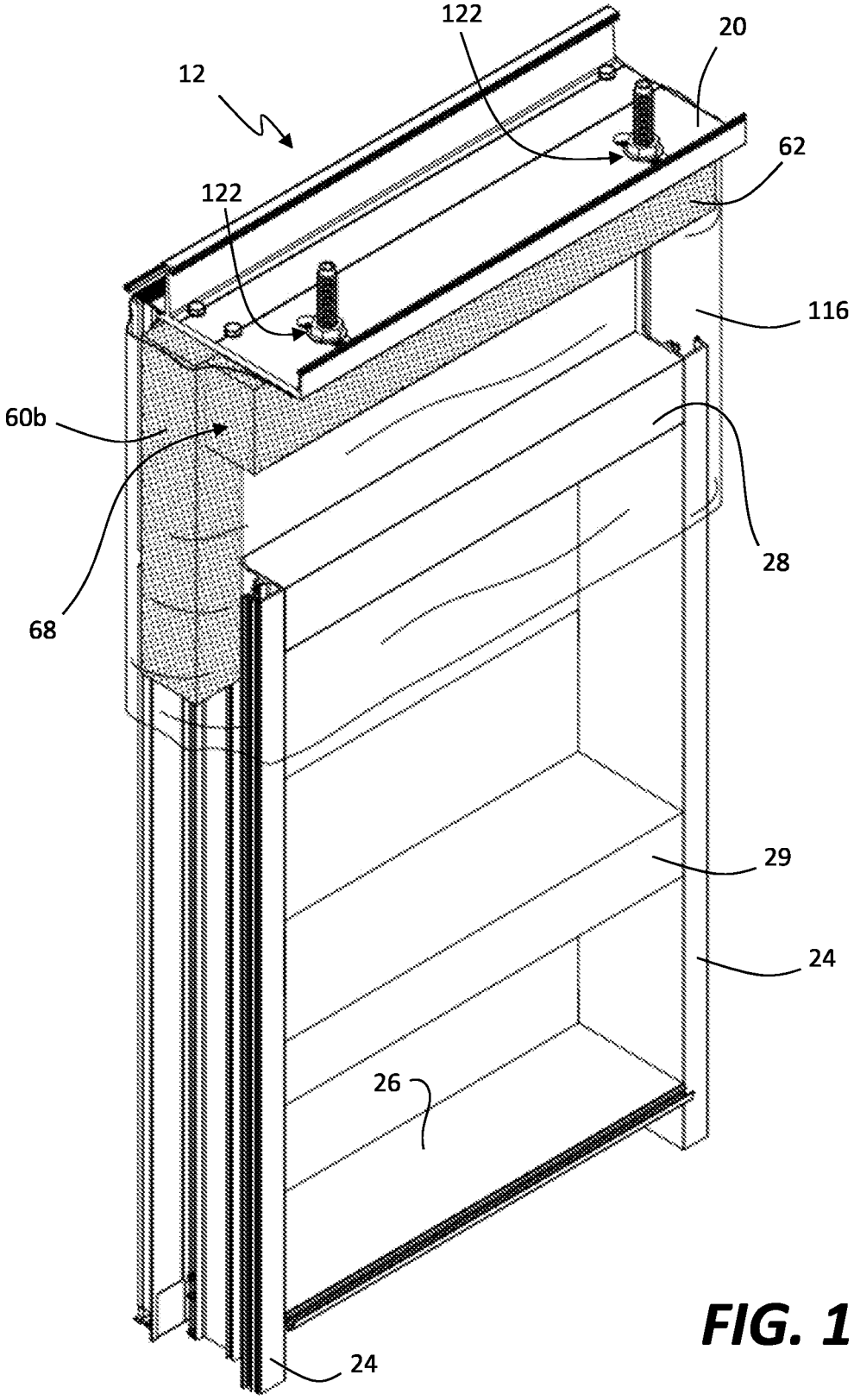
FIG. 15 is a perspective view of a curtain panel prepared for transportation in accordance with the principles of the present invention.

Similarly, a plurality of rectangular slab cover frames 32 are formed and defined between the adjacent pairs of vertical mullions 24, the edge cover support members 28 and the shelf members 20 on the above floor slab FS. The slab edge cover panels 14 are sized to fit within and be adhered to the rectangular slab cover frames 32. More particularly, the slab edge cover panels 14 are supported on the edge cover support members 28 and are adhered along their perimeter edges to the adjacent pairs of vertical mullions 24, the edge cover support members 28 and the shelf members 20 on the above floor slab AFS. As best seen in FIGS. 3 and 15, additional horizontal infill support members 29 can be provided between the lower infill support members 26 and the edge cover support members 28 whereby the vertical space between floor slabs can be split up and different infill materials can be used in the spaces thereof.

The shelf members 20 include fastener bores (not shown) provided extending vertically through the shelf members 20. The fastener bores are adapted to receive frame fasteners 21 therethrough. As the frame fasteners 21 are extended through the fastener bores, the frame fasteners 21 threadingly engage a pair of male and female mullion halves 34*m*, 34*f* for thereby securing the male and female halves 34*m*, 34*f* to the shelf member 20. A sealant (not shown) can then be applied completely covering the frame fasteners 21 for thereby sealing the fastener bores.

The infill support members 26 further include infill support splines 102 and the edge cover support members 28 can include edge cover support splines 104. The infill support splines 102 and the edge cover support splines 104 can be adapted to threadingly receive frame fasteners (not shown) for thereby securing the vertical mullions 24 to the infill support members 26 and the edge cover support members 28 respectively.

As should now be appreciated, the weight of the infill panels 16 is transferred from the infill support members 26 to the vertical mullions 24. The weight of the slab edge cover panels 14 is transferred from the edge cover support members 28 also to the vertical mullions 24. Hence, the infill panels 16 and the slab edge cover panels 14 are "hung" on the shelf members 20 on the above floor slab AFS with the vertical mullions 24, and the vertical mullions 24 are, therefore, in tension.

Figure 8:
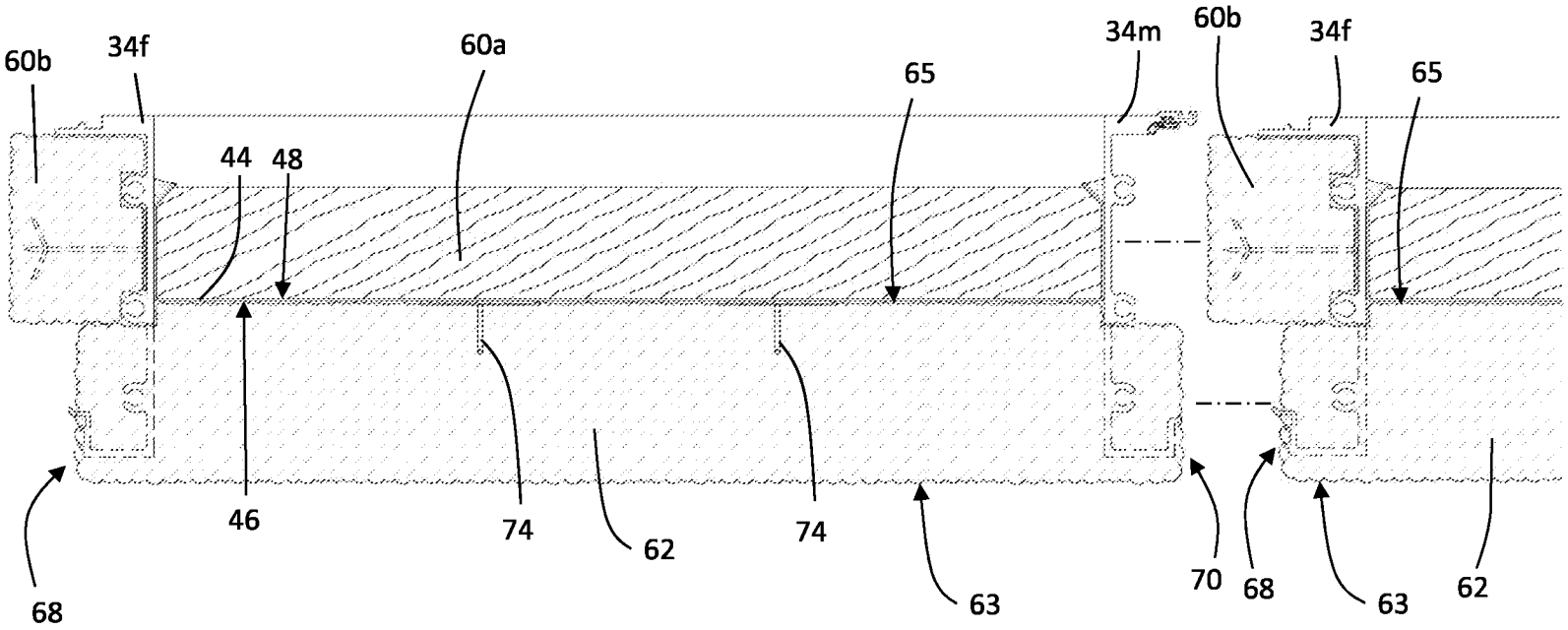
FIG. 8 is a partially exploded cross section view of the framework shown in FIG. 2 taken along line 8-8.
Figure 9:
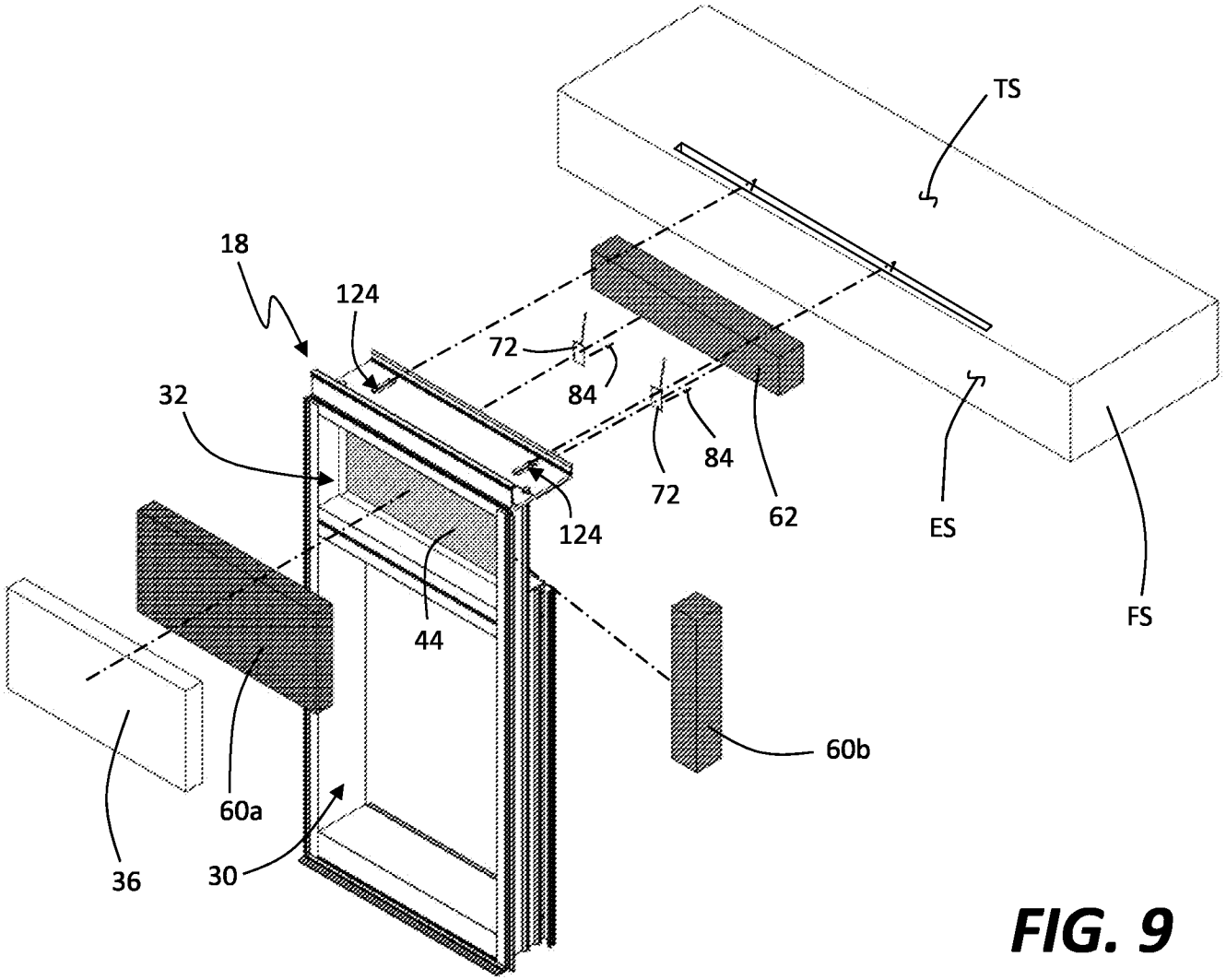
FIG. 9 is an exploded perspective view of a curtain panel constructed in accordance with the principals of the present invention as mounted on a floor slab.
Figure 10:
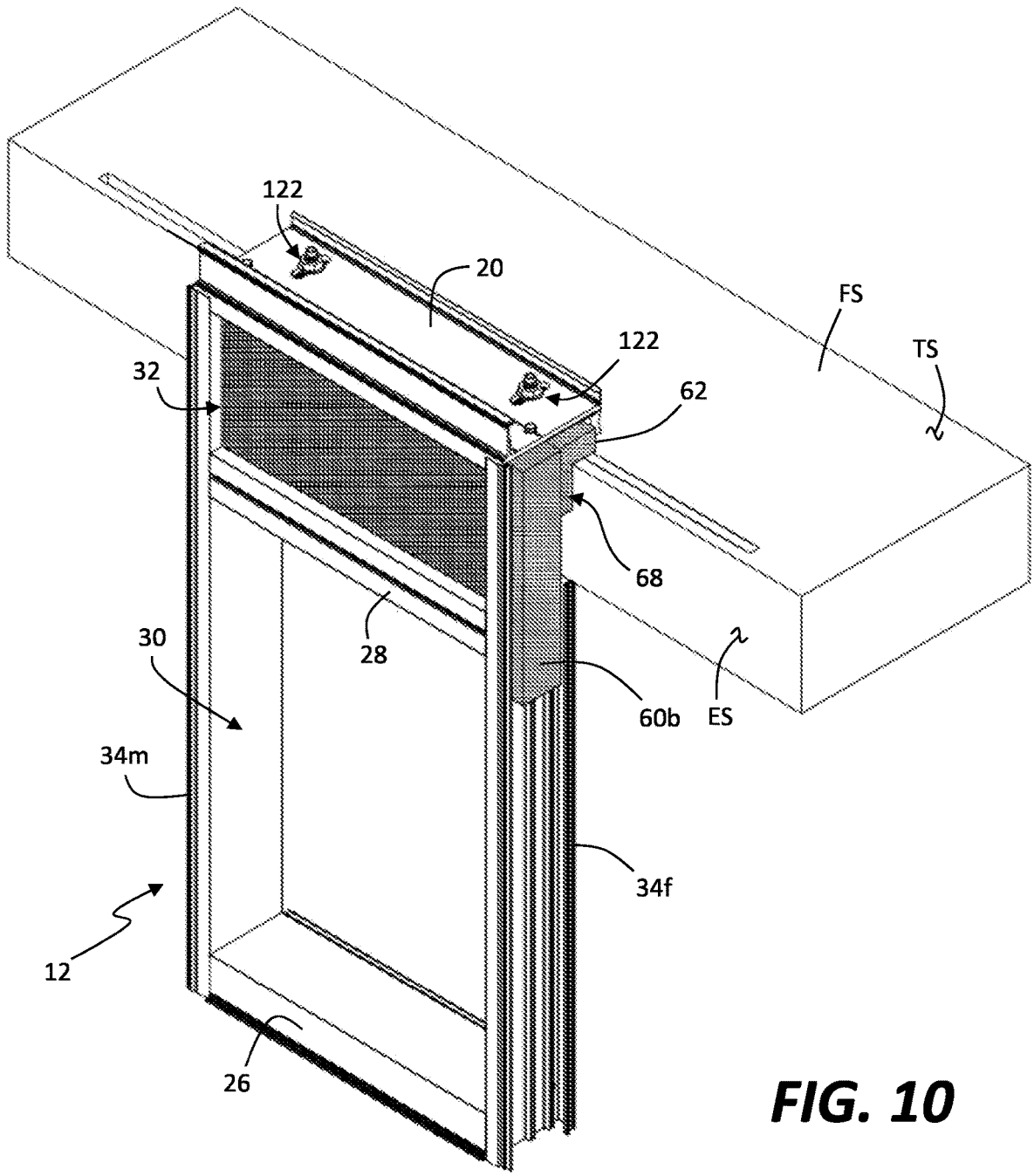
FIG. 10 is an assembled perspective view of the curtain panel shown in FIG. 9 mounted/hung on a floor slab.
Figure 11:
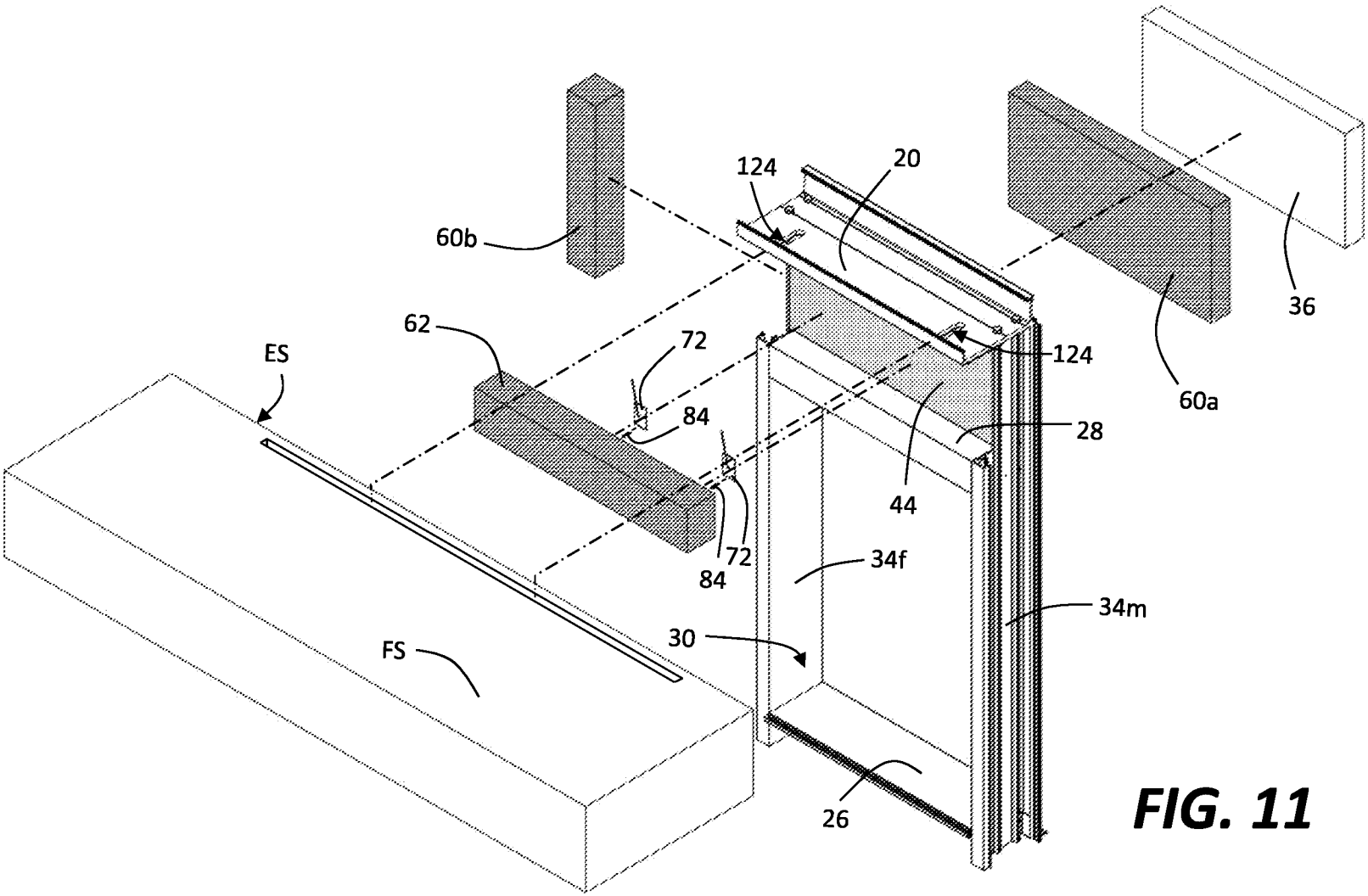
FIG. 11 is an exploded view of the curtain panel mounted on a floor slab similar to FIG. 9, but from a different perspective.
Figure 12:
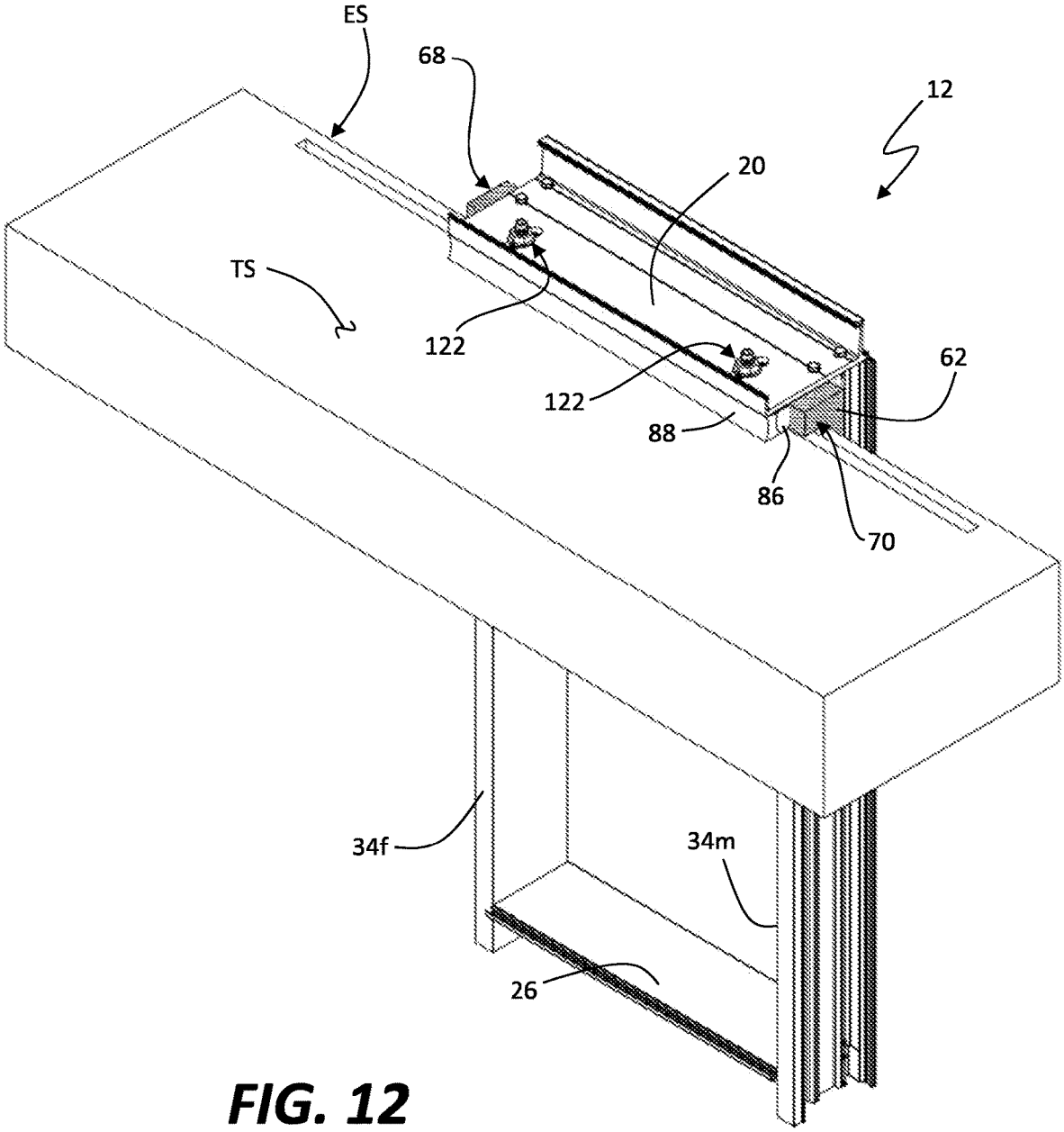
FIG. 12 is an assembled view of the curtain panel shown in FIG. 9, but from a perspective similar to FIG. 11.

As best seen in FIG. 8, the vertical mullions 24 are rectangular shaped in cross section and comprise a female pan shaped half 34*f* and a male pan shaped half 34*m*. The male and female halves 34*m*, 34*f* securely snap together to form the rectangular shaped vertical mullions 24 in a known and customary manner. As best seen in FIG. 4A, an inside portion of the vertical mullion halves 34*f*, 34*m* can be milled or otherwise removed for thereby providing a cutout or notch 34*c* on the inside portion of the vertical mullions 24. The terminal part of the floor slab FS and the floor slab terminal edge surfaces ES project into and are received in the cutouts 34*c*. The cutouts 34*c* thereby, advantageously, allow the infill panels 16 and slab edge cover panels 14 to be located closer to the slab edge terminal surfaces ES.

The slab edge cover panels 14 typically comprise insulated glass panels 36 constructed in a known and customary manner and sized to fit within the framework 18. The insulated glass panels 36 shown are constructed with an exterior glass pane 38 adhered to an interior glass pane 40 along a sandwiched spacer 42 extending along the perimeter thereof, although many other layers can also be used as needed or desired. An insulating air space is thereby sealed and provided between the glass panes 38, 40.

As best seen in FIGS. 4A-C, the slab edge cover panel 14 further comprises rectangular backpans 44 supported on the edge cover support members 28 between pairs of adjacent vertical mullions 24. The backpans 44 are sized to fit within and be adhered to the rectangular slab cover frames 32 whereby the backpans 44 are positioned horizontally between the insulated glass panels 36 and the floor slabs FS. The backpans 44 comprise interior backpan surfaces 46 facing the floor slab terminal edge surfaces ES, exterior backpan surfaces 48 facing the insulated glass panels 36, and perimeter backpan edge surfaces 50 adapted to be placed against/abutting the slab cover frames 32. The backpan 44 is preferably constructed from a fire-resistant material such as, for example, steel, aluminum, and sheet metal.

The backpan 44 can be either pan shaped (as best seen in FIGS. 6B, 8, 13, and 14) whereby the perimeter edge surfaces of the backpan 44 are adapted to be placed against/abutting the slab cover frames 32, or the backpan 44 can be a flat sheet (as best seen in FIGS. 4A-C). In the flat sheet embodiment of backpan 44, as best seen in FIG. 4B, a pair of parallel, adjacent ridges 56 can be provided extending downwardly from the shelf member 20. The ridges 56 are disposed apart from one another for thereby forming gap therebetween which can be adapted to receive the backpans 44 therein whereby the perimeter edge surfaces 50 can be inserted between the ridges 56 and the backpan 44 can be secured therein.

As best seen in FIG. 4C, the edge cover support member 28 can include a slot 58 extending into the surface of the edge cover support member 28 whereby the slot 58 is parallel to and facing the ridges 56. Similar to the ridges 56, the slot 58 is sized to receive the backpan 44 therein whereby the perimeter edge surfaces 50 can be inserted into the slot 58 and the backpan 44 can be secured therein.

Once the backpan 44 has been adhered to the rectangular slab cover frames 32, the perimeter edges of the backpan 44 are sealed in a known and customary manner to ensure an airtight fitment between the backpan 44 and the rectangular slab cover frames 32.

Thermal insulation layers 60*a* can be provided and adhered to the exterior backpan surfaces 48 between the backpans 44 and the insulated glass panels 36. The thermal insulation layers 60*a* can be rectangular sheets of thermal insulation which are cut to size and configured to snugly fit between adjacent pairs of vertical mullions 24 and between the shelf members 20 and the edge cover support members 28. The thermal insulation layers 60*a* can be adhered using, for example, weld pins (not shown) inserted through the thermal insulation layers 60*a* and welded to the backpans 44 in a known and customary manner.

Thermal insulation layers 60*b* can be provided and adhered inside the vertical mullions 24 between the male and female halves 34*m*, 34*f*. The thermal insulation layers 60*b* can be rectangular sheets of thermal insulation which can be cut to size and configured to snugly fit between the male and female halves 34*m*, 34*f* whereby the thermal insulation layer 60*b* completely fills the space between the male and female halves 34*m*, 34*f*.

The insulation layers 60*a* and 60*b* can be made of fire-resistant materials such as stone wool, mineral wool, fiberglass and/or other types of compressible, fire-resistant insulation which, preferably, also prevent acoustic transmission.

Figure 6B:
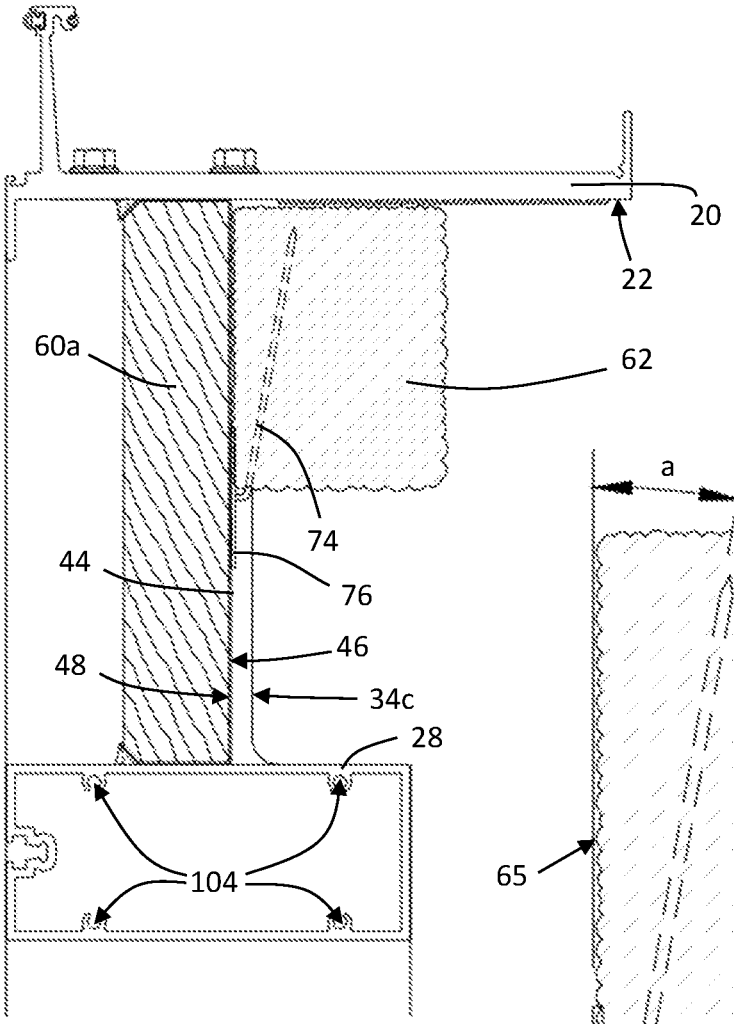
FIG. 6B is a side plan view of the framework shown in FIG. 2, wherein a pair of male and female pan halves have been removed for clarity, and showing fire-safing insulation secured to the curtain panel.
Figure 6A:
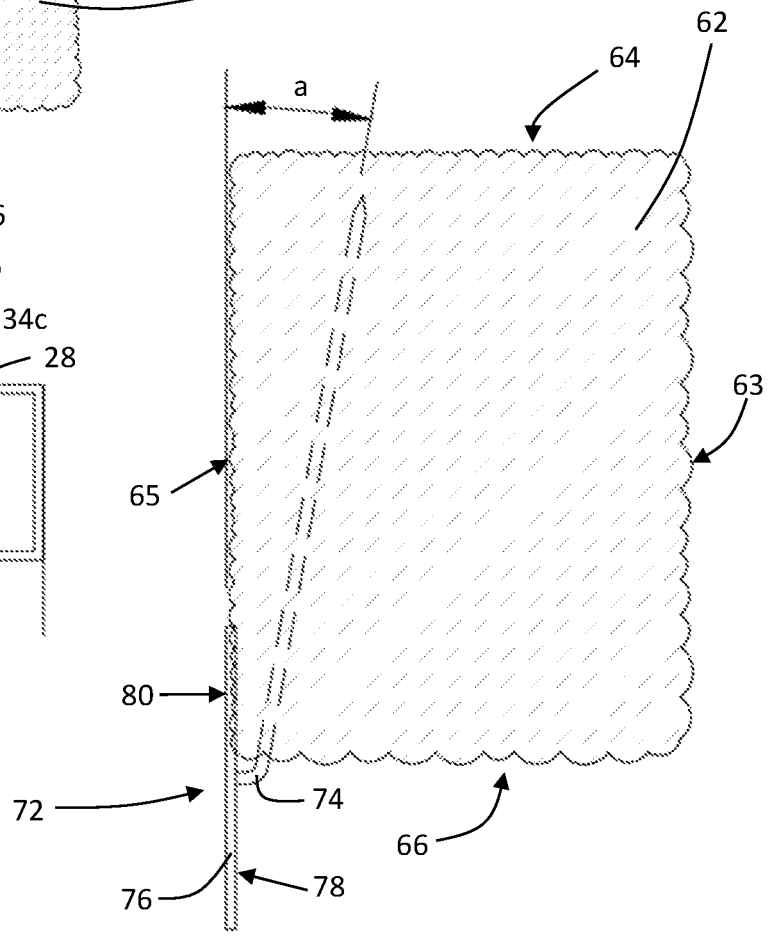
FIG. 6A is a side plan view of the impaling pin of FIG. 5B embedded in fire-safing insulation.

As best seen in FIGS. 6A-B and 8, fire-resistant fire-sating insulation 62 is provided and is secured to the curtain panels 12. Preferably the fire-safing insulation 62 is provided on the slab edge cover panel 14/backpan surface 46 and most preferably in the corner formed between the slab edge cover panel 14/backpan surface 46 and the shelf members 20/bottom shelf surface 22. Fire-safing insulation 62 can be elongate, rectangular in cross section shaped, as shown having an upper surface 64, a lower surface 66, an inner side surface 63, an outer side surface 65 and first and second terminal ends 68, 70.

Figure 16:
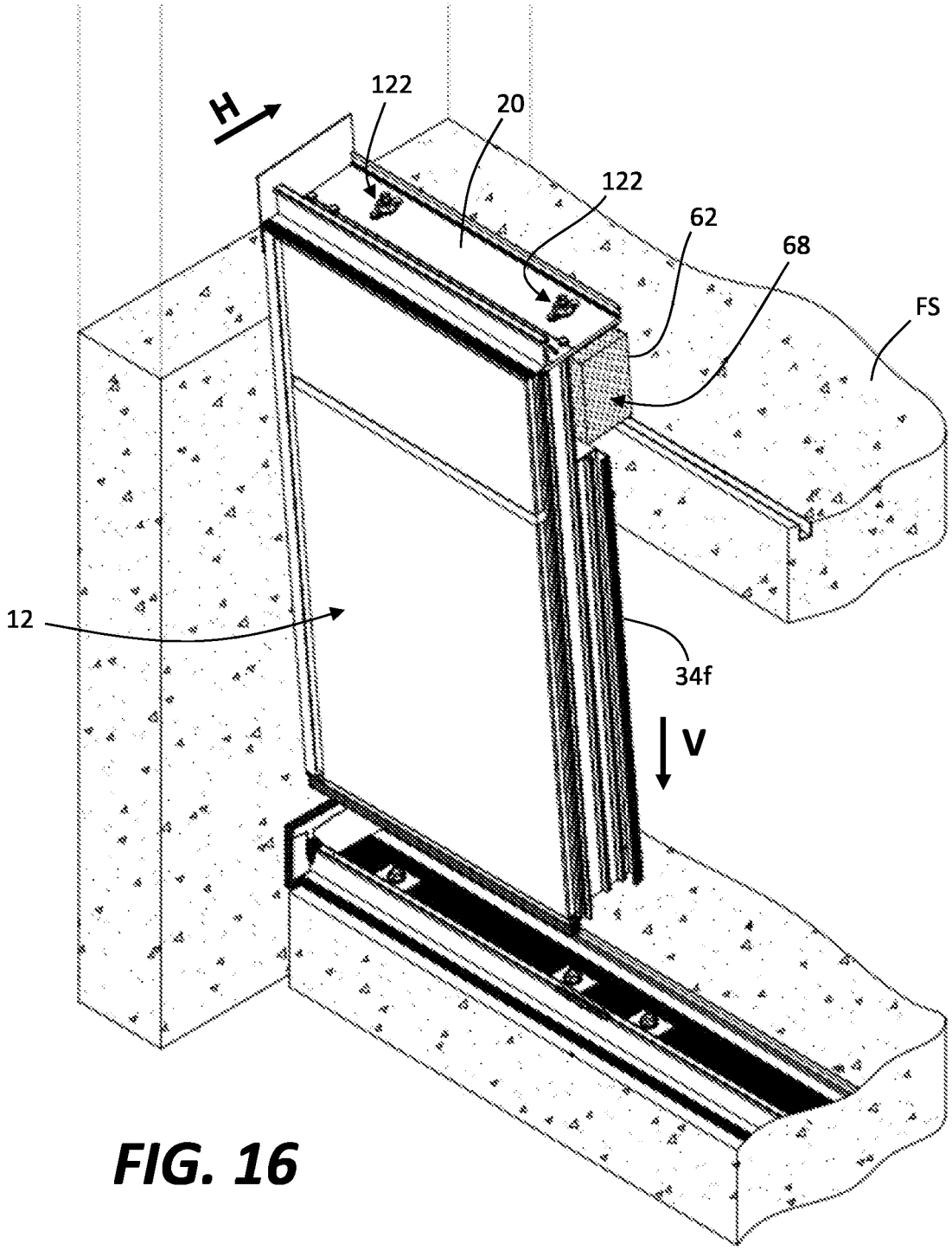
FIG. 16 is an exploded perspective view of a curtain panel being mounted on a floor slab in accordance with the principles of the present invention.
Figure 17:
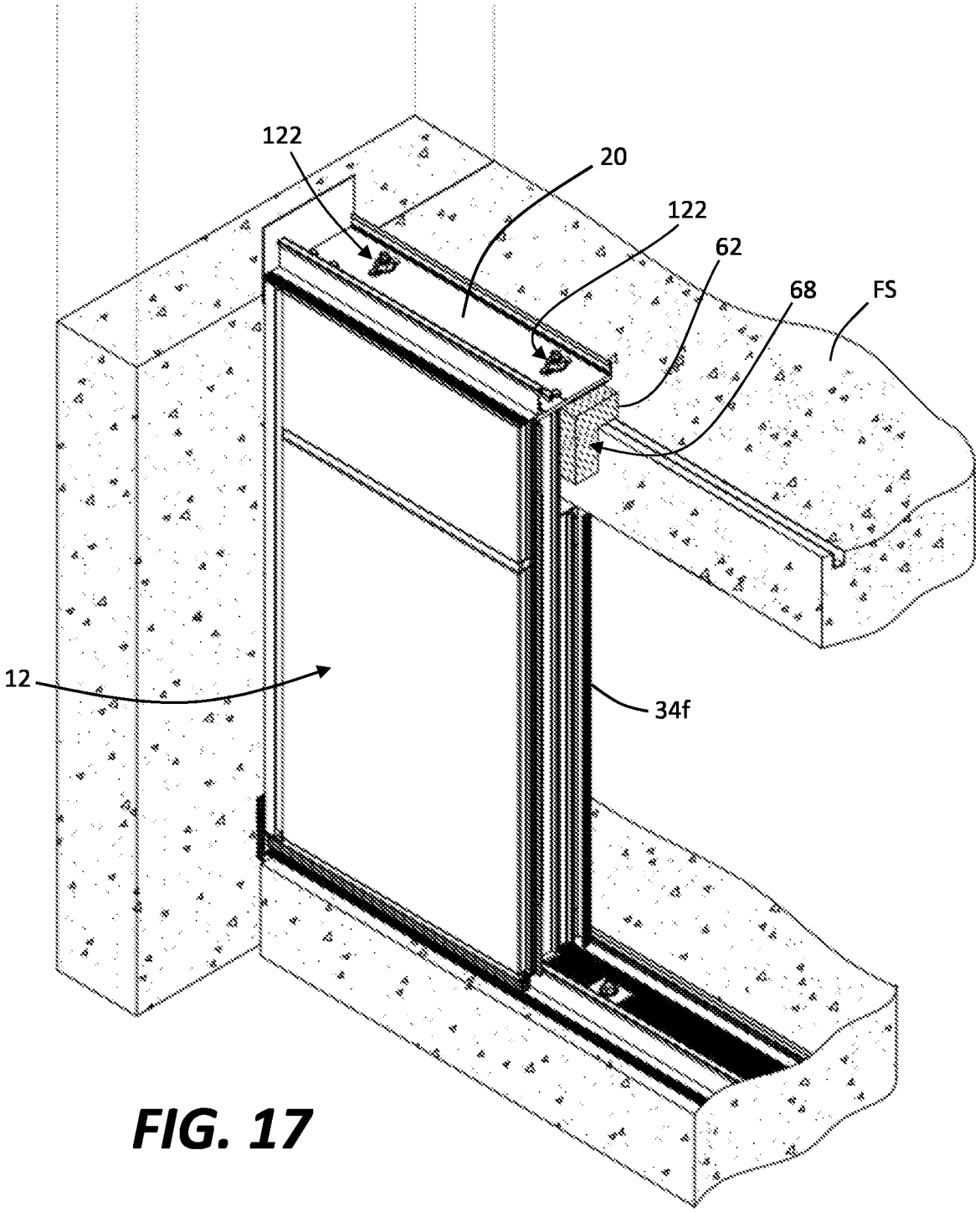
FIG. 17 is a perspective view of the curtain panel shown in FIG. 16, after it has been mounted on the floor slab.

As shown in FIG. 8, preferably the fire-sating insulation 62 is sized such that the first and second terminal ends 68, 70 extend slightly past the outboard edges of the male and female mullion halves 34*m*, 34*f* respectively. Accordingly, when adjacent curtain panels 12 are installed on a building floor slab FS as shown in FIGS. 16-18 and the mullion halves 34*m*, 34F are securely snapped together to form the vertical mullions 24, the fire-safing insulation 62 secured to each curtain panel 12 is longitudinally compressed against adjacent fire-safing insulation 62 (the first terminal ends 68 and second terminal ends 70 thereof are compressed towards each other) for thereby forming a continuous strip of fire-safing insulation 12 along the edge of the floor slab FS.

As shown in FIGS. 5A-B and 6A-B, the fire-safing insulation 62 can be adhered to the curtain panel 12 using one or more impaling pins 72. The impaling pins 72 comprise a needle member 74 and a planar base member 76 having a needle surface 78 and an adhesion surface 80. The adhesion surface 80 is preferably provided with noncombustible double-sided adhesive tape or other fast setting adhesives. The needle member 74 is secured to and extends from the needle surface 78, and the adhesion surface 80 is adapted to be placed against/abutting the interior backpan surface 46.

The impaling pins 72 are prepared for installation by bending the needle member 74 relative to the planar base member 76 such that the angle between the needle member 74 and the needle surface 78 is less than 90 degrees. For example, as best seen in FIG. 6A, the needle member 74 can preferably be bent until the needle member 74 extends at an angle "a" of approximately 10 degrees relative to the plane of the needle surface 78. The acute angle at which the needle members 74 extend from the needle surfaces 78 is configured such that, when the curtain panels 12 are installed on the floor slabs FS, the needle members 74 can flex and bend away from the floor slabs FS and towards the curtain panel 12 to allow and not interfere with the fire-safing insulation from being compressed in and filling the gap/fire-safing slot G between the curtain panel 12 and the floor slab FS terminal edge surface ES.

To install the fire-sating insulation on a curtain panel 12, the needle members 74 are preferably first secured to the fire-sating insulation 62 by inserting the needle member 74 upwardly through the lower surface 66 as shown in FIG. 6A. The adhesion surface 80 is then firmly pressed against/abutting the interior backpan surface 46, thereby adhering the impaling pins 72 thereto and securing the fire-safing insulation to the curtain panel 12 as shown in FIG. 6B.

Preferably, to assure the fire-safing insulation 62 remains fastened to the curtain panel 12 during transport and prior to installation, the planar base members 76 can be further secured to the backpan 44 with fasteners 84. The fasteners 84 can be driven through the impaling pin planar base 76 and the backpan 44. The fasteners 84 can be for example, screws, rivets, and nuts and bolts (not shown).

Alternatively, the planar base members 76 can be secured to the backpan 44 using fasteners 84 alone without the use of adhesives. Also, it is contemplated that the fire-safing 62 can be secured to the curtain panels only with a noncombustible adhesive.

Figure 13:
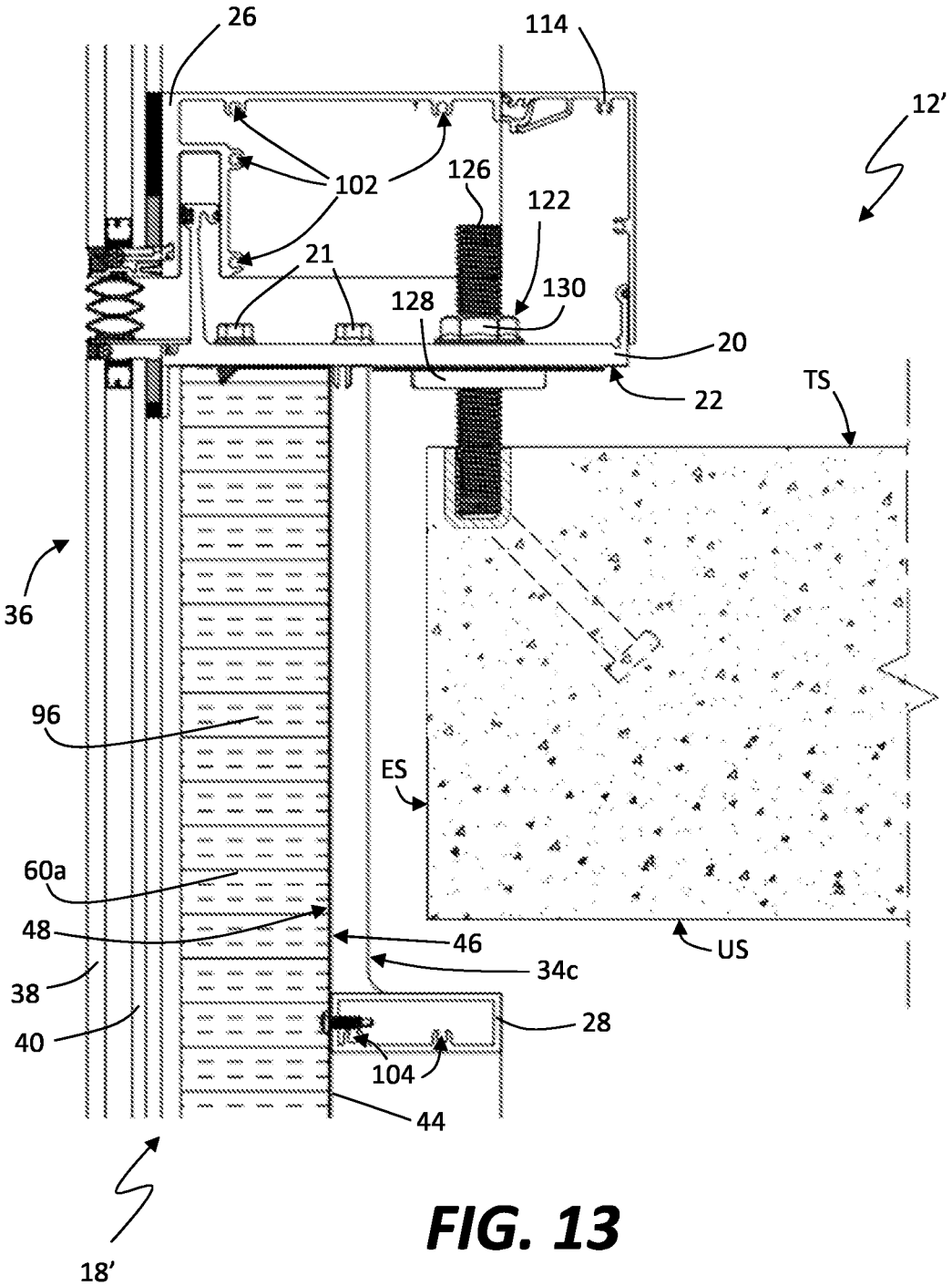
FIG. 13 is a cross section view of another representative curtain panel constructed in accordance with the principles of the present invention, wherein the cross section view is taken along line 4-4, and wherein the fire-sating insulation, the impaling pins, the backer rods, and the sealant have been removed for clarity.
Figure 14:
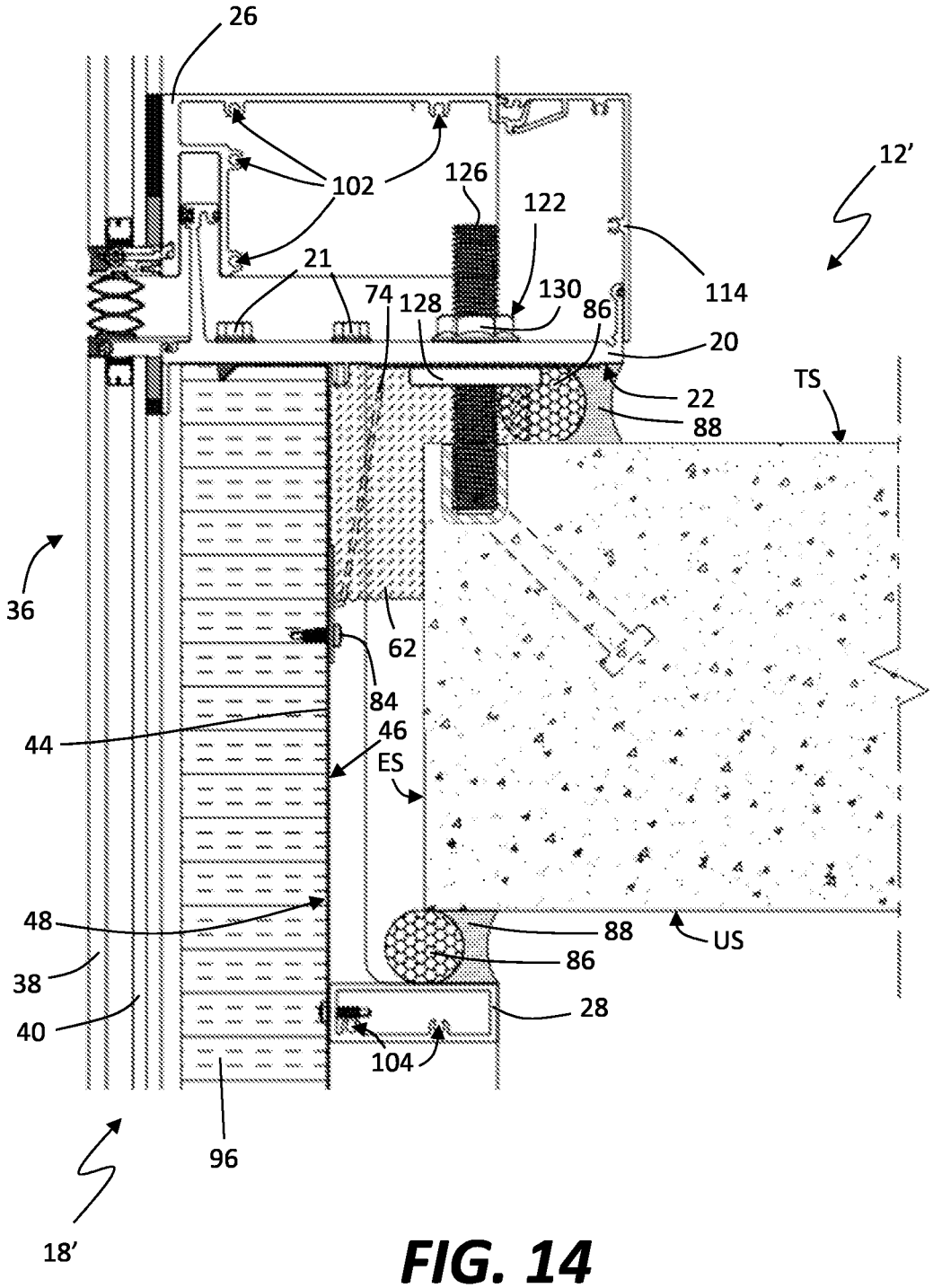
FIG. 14 is a second cross section view of the curtain panel shown in FIG. 13 wherein the fire-safing insulation, the impaling pins, the backer rods, and the sealant are shown.

A second representative curtain panel 12' is shown in FIGS. 13 and 14. The curtain panel 12' is similar to the curtain panel 12 except an insulated panel 96 is provided instead of the thermal insulation 60*a*. The insulated panel 96 is supported on the framework 18' and extends along and in the slab edge frame 32 and also along and in the infill frame 30, thereby thermally enclosing the building interior space at each level L1, L2, and L3 between successive floor slabs FS.

The curtain panels 12' further similarly comprise backpans 44 made of a noncombustible material and secured to the framework 18'. Also, fire-safing insulation 62 is similarly secured thereto with impaling pins 72 and preferably fasteners 84 and/or noncombustible adhesives.

As shown in FIG. 15, after the thermal insulation 60*b* and the fire-safing insulation 62 have been secured to the curtain panels 12, the thermal insulation 60*b*, fire-safing insulation 62 and the upper end of the curtain panels 12 can be wrapped with a protective sheeting material such as plastic film 116 for protection thereof during transportation to a work site. The film 116 can be removed immediately prior to installation of the curtain panels 12.

Figure 7:
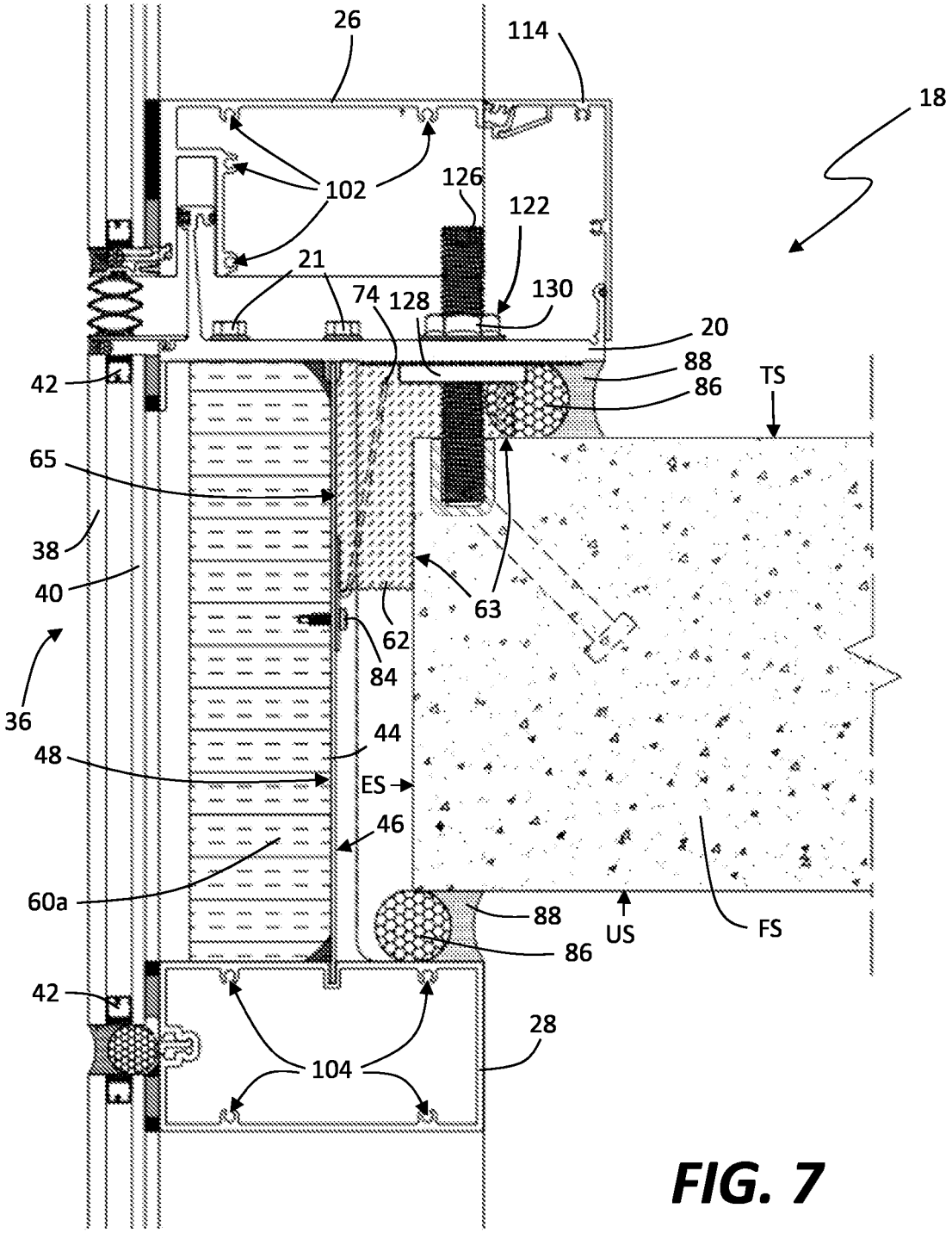
FIG. 7 is a cross section view of the framework shown in FIG. 2 taken along line 4-4, showing a curtain panel after it has been hung/installed on a building floor slab and showing the fire-safing insulation compressed both horizontally in the gap/fire-safing slot between the curtain panel and the slab terminal edge and also in the space between the floor slab and curtain wall the shelf member.

When installing the curtain panels 12 and hanging them on an above floor slab AFS in accordance with the principles of the present invention, as depicted in FIG. 16, the curtain panels 12 travel/are traversed vertically as depicted by arrow V and at least the top portion of the panels travel/are traversed horizontally as depicted by arrows H thereby sandwiching the fire-safing insulation 62 between the curtain panel 12 and the floor slab FS as shown in FIG. 7. As shown in FIGS. 16 and 17, a first curtain panel 12 can be installed on a floor slab FS by positioning the curtain panel 12 in front of the slab edge surface ES whereby the shelf member 20 is above the AFS top surface TS. The curtain panel 12 is then lowered towards the BFS as depicted by arrow V until the lower infill support member 26 thereof engages a shelf member 20 therebelow, which is secured to the BFS as shown in FIG. 16 or is part of a below curtain panel as shown in FIG. 7, and the top of the curtain panel is traversed horizontally as depicted by arrow H whereby the hanging and panel position adjusting mechanisms 122 engage and bear on the AFS and, further, whereby the fire-safing insulation is sandwiched and is compressed between the backpan 44 and shelf member 20 of the curtain panel 12 and the terminal edge ES and top surface TS of the floor slab FS. The mechanisms 122 can include, for example, shelf member slots 124 extending horizontally through the shelf members 20, posts 126, support pads 128, and locknuts 130 as described in the LeVan Patents for adjusting the vertical and horizonal position of the curtain panel 12.

As the curtain panels 12 are lowered and traversed horizontally onto the AFS, as best seen in FIG. 7, the preinstalled fire-safing insulation 62 carried by the curtain panel is deformed and is compressed between the curtain panel 12 and the floor slab FS. Advantageously, the fire-safing insulation 62 is thereby provided both in the gap/fire-safing slot G between the curtain panel and the slab terminal edge ES whereat it is compressed horizontally and, also, continuously, in the space between the floor slab FS top surface TS and the curtain wall the shelf member 20 whereat it is compressed vertically. Stated similarly, as the curtain panels 12 are being hung and positioned, the top corner of the floor slab terminal edge surface ES (formed at intersection of the floor slab terminal edge surface ES and the slab top surface TS) is pushed into the fire-safing insulation 62 towards the corner formed between the slab edge cover panel 14/backpan surface 46 and the shelf members 20/bottom shelf surface 22, for thereby deforming and compressing the fire-safing insulation 62 both horizontally and vertically, and thereby creating a fire-safing seal which extends both vertically and horizontally. Additionally, as the fire-safing insulation 62 is being deformed and compressed, the needle members 74 can bend away from the floor slabs FS as may be needed, towards the curtain panel 12, to allow and not interfere with the deformation and compression thereof and to allow the fire-safing insulation to fill the gap/fire-safing slot G between the curtain panel 12 and the floor slab FS and the space between the floor slab FS top surface TS and the curtain wall the shelf member 20.

By forcing a fire to travel/penetrate both vertically and horizontally through the fire-safing insulation 62, the effective thickness and seal of the fire-safing insulation 62 through which a fire must penetrate is significantly increased. Therefore, a fire can be more efficiently and effectively be prevented from climbing between floor levels by the use of the curtain panels 12 and the fire-safing insulation 62 which is installed as described hereinabove. Beneficially, sealing the edge of the floor slab FS by compressing the fire-sating insulation 62 both vertically and horizontally as described also reduces the transmission of sound between floors because the shelf members 20 and the fire-sating insulation 62 also act as baffles that reflect and absorb sounds.

Figure 18B:
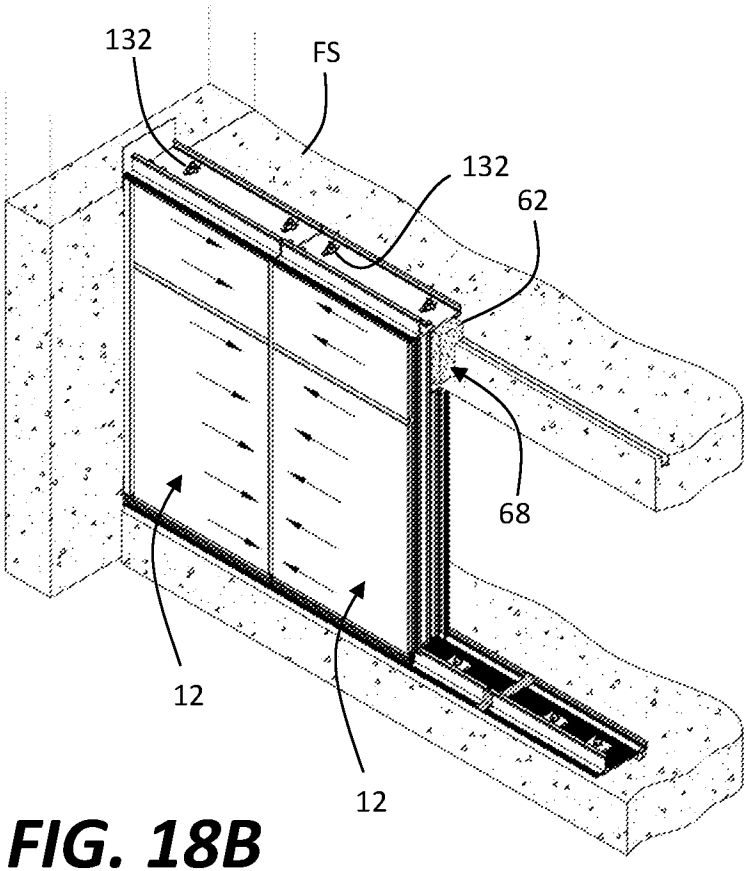
FIG. 18B is an assembled perspective view of the curtain panels shown in FIG. 18A.
Figure 18A:
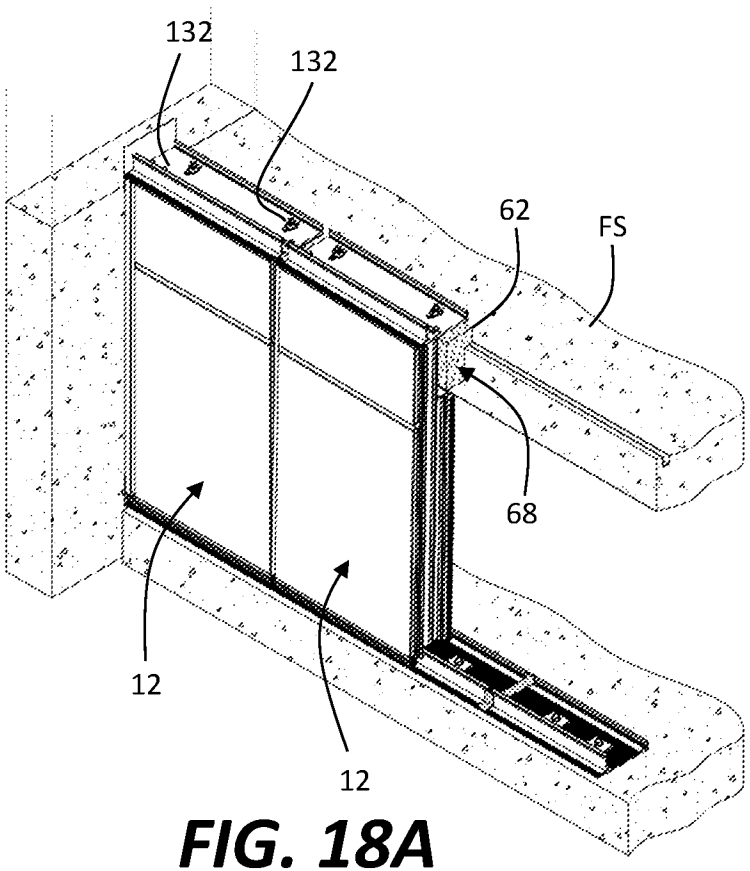
FIG. 18A is a diagrammatic perspective view of adjacent curtain panels as they are pressed towards each other and the mullion halves are being snapped together.
Figure 19B:
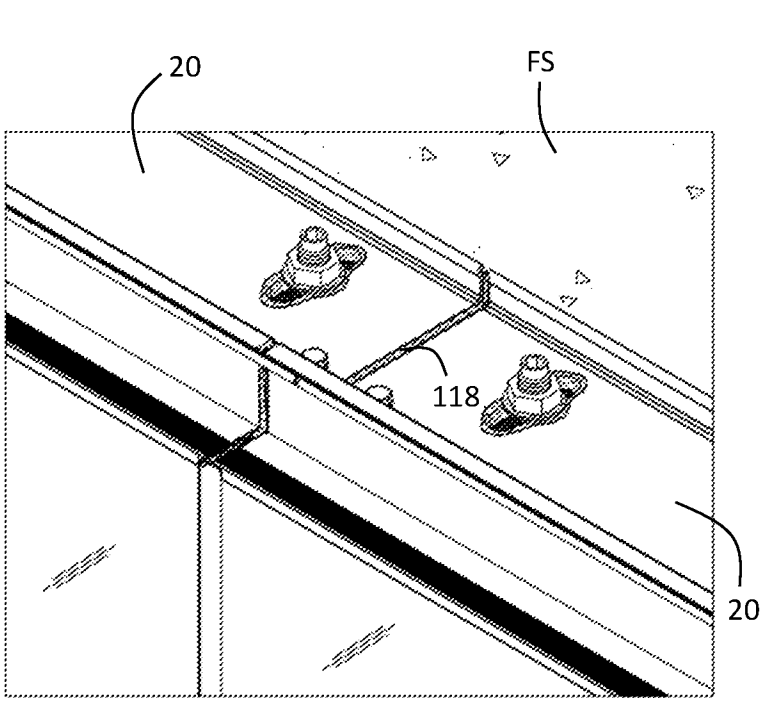
FIG. 19B is a perspective similar to FIG. 19A but wherein sealant has been applied in the gap.
Figure 19A:
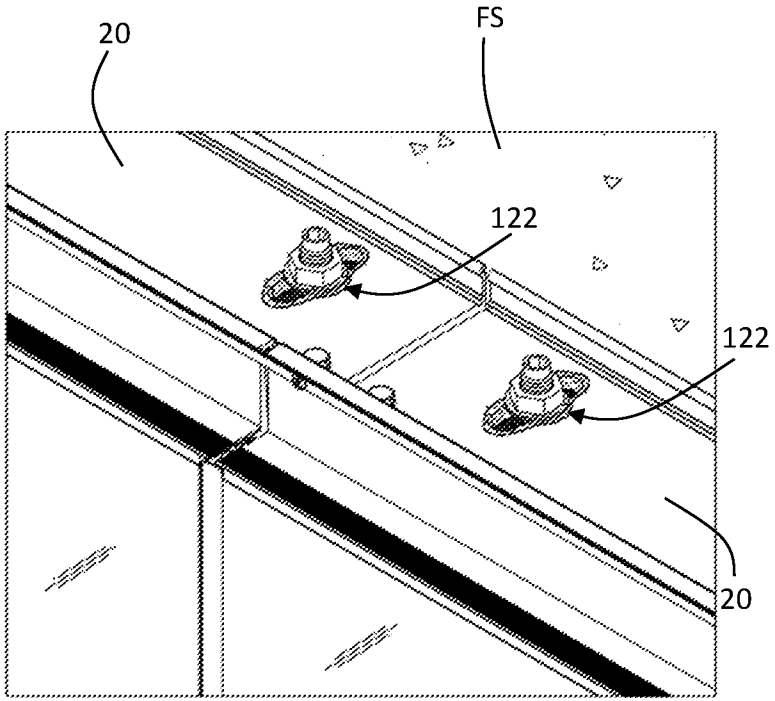
FIG. 19A is a magnified perspective view of the gap between the adjacent curtain panel shelf members shown in FIG. 18B.
Figure 19D:
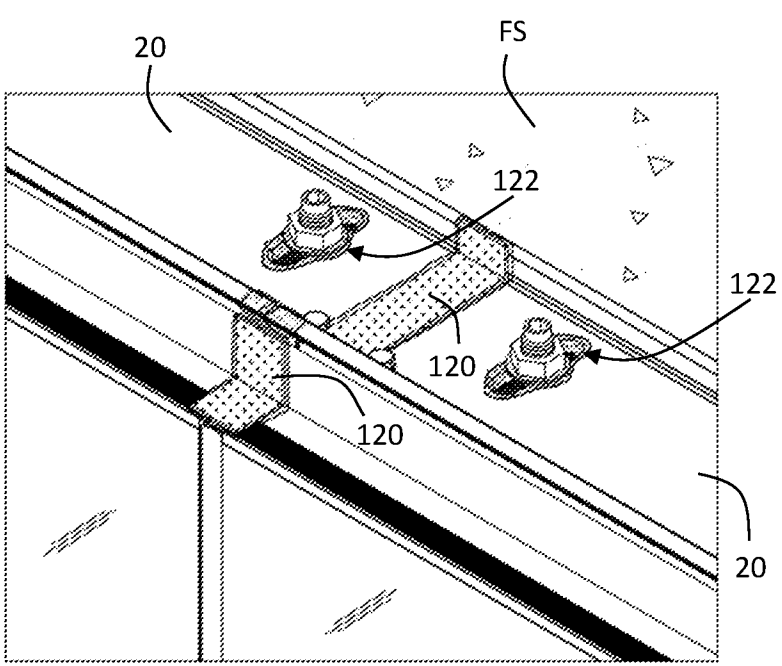
FIG. 19C is a perspective similar to FIG. 19B but wherein additional sealant has been applied surrounding the gap; and, FIG. 19D is a perspective view similar to FIG. 19C but wherein a sealing strip has been applied over the sealant.
Figure 19C:
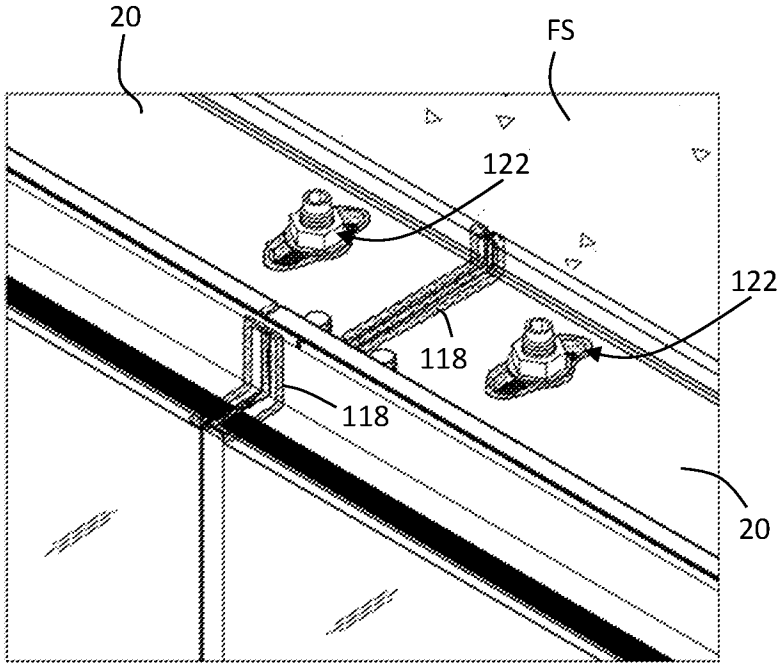

As shown in FIGS. 18A-B, successive curtain panels 12 can be lowered and installed/hung onto the floor slab FS adjacent to the previously installed/hung curtain panels 12. To secure the successive curtain panels 12 to the already installed/hung curtain panels 12, the successive curtain panel 12 is slidingly moved toward the already installed/hung curtain panel 12. The successive curtain panel 12 is then firmly pressed against the previously installed/hung curtain panel 12 for thereby securely snapping together the pair of adjacent male and female mullion halves 34*m*, 34*f* therebetween. The vertical and horizontal position of the successive curtain panel 12 is thereafter adjusted using the mounting apparatuses 122 thereof, and the installation/hanging and adjusting process is repeated until the curtain wall 12 is completed.

As mentioned hereinabove, advantageously, after adjacent curtain panels 12 are installed on a building floor slab FS and the mullion halves 34*m*, 34F thereof are securely snapped together to form the vertical mullions 24, the fire-safing insulation 62 secured to each curtain panel 12 is longitudinally compressed against the adjacent panel fire-safing insulation 62 (the first terminal ends 68 and second terminal ends 70 thereof are compressed towards each other) for thereby forming a continuous strip of fire-safing insulation 12 along the edge of the floor slab FS which prevents fire and acoustic transmission.

Preferably, after the curtain panels 12 have been installed/hung on a floor slab FS, the shelf member slots 124, the posts 126, and the locknuts 130 can be completely covered with a noncombustible sealant 132 for thereby sealing any openings in the shelf members 20 and thereby yet further preventing the transmission of fire or fumes through the shelf members 20.

As shown in FIGS. 19A-D, a gap is typically formed between adjacent curtain panel shelf members 20. To seal the adjacent shelf members 20 together and prevent any fire or fumes from traversing through the gaps therebetween, a noncombustible sealant 118 can be applied within, and completely filling, the gaps between the adjacent shelf members 20. Once the gaps have been filled with sealant 118, additional sealant 118 can be applied surrounding the gap and a sealing strip 120 can pressed into the sealant 118 for thereby adhering the sealing strip 120 to the shelf members 20. Sealant 118 can further be applied along the perimeter of the sealing strip 120 and the sealant 118 can be tooled smooth for thereby sealing the edges of the sealing strips 120 and removing any excess sealant 118.

As shown in FIG. 7, after the curtain panels 12 are installed as described hereinabove, compressible backer rod 86 can be inserted between the shelf members 20 and the floor slab top surfaces TS and, also, between the horizontal edge cover support members 28 and the floor slab underside surface US. A smoke and fumes fire resistant sealant, a noncombustible sealant and/or an aesthetically pleasing (available in different colors) standard non-combustible silicone weatherproofing sealant 88 can then be applied against the backer rods 86 completely filling the horizontal gaps between the shelf members 20, the horizontal edge cover support members 28, and the floor slab FS for thereby further sealing the gaps between the curtain panels 12 and the floor slabs FS.

Although the fire-safing insulation 62 is preferably rectangular in cross section as described hereinabove, it is contemplated that its cross section can take on various forms, provided that one or more surfaces thereof can extend along and be compressed against the floor slab edge surface and/or the floor slab top surface TS. For example, the cross-section shape thereof can be oval, circular and, also, indefinite. The cross-section shape thereof can also be L-shaped, fitted within the corner formed between the slab edge cover panel 14/backpan surface 46 and the shelf members 20/bottom shelf surface 22 and having a mirror image L-shaped surface adapted to receive the top corner of the floor slab terminal edge surface ES.

As should now be appreciated, the fire-sating insulation 62 is advantageously factory applied/secured to the façade panels in a controlled interior factory environment in a manner whereby it is installed in the field simultaneously with the façade panels thereby decreasing the installation time and overall cost thereof and resulting in much higher quality fire-safing than the prior field applied fire-sating systems. Also, by employing the factory applied/secured fire-sating to façade panels of the type described in the LeVan patents and hereinabove, a superior building facade can be provided wherein, not only are the floor slabs bifurcated/enveloped and/or sandwiched between the shelf members 20 and the edge cover support members 28 so that there are no gaps/slots requiring fire-sating (similar to window walls with slab edge covers) but, also, further includes fire-safing insulation along the slab edge ES and slab top surface TS.

While this invention has been described as having an exemplary design, the present invention may be further modified within the spirit and scope of this disclosure. This application is therefore intended to cover any variations, uses, or adaptations of the invention using its general principles.

What is claimed is:

1. A method of installing a façade on a building structure comprising a plurality of vertically stacked levels defined by horizontally arranged floors therebetween, the method comprising the steps of:

providing a plurality of façade panels, wherein one of more of the façade panels includes a strip of fire-safing insulation;

hanging the one or more façade panels on the one or more building floors adjacent an edge thereof;

wherein during the step of hanging, the façade panels and strip of fire-safing insulation are simultaneously traversed vertically downwardly and horizontally towards the floor edge thereby sandwiching and compressing at least a portion of the strip of fire-safing insulation between the one or more façade panels and the floor edge; and, wherein the one of more of the façade panels further includes a shelf member extending therefrom and defining a corner therebetween, and wherein the strip of fire-safing insulation is provided substantially in the corner and wherein, during the step of hanging, further comprising the step of placing a portion of the shelf member over the floor edge and sandwiching at least a portion of the strip of fire-safing insulation between the one or more façade panels and a vertical surface of the floor and between the shelf member and a horizontal surface of the floor.

2. The method of claim 1 wherein, after the step of hanging, the strip of fire-safing insulation engages the floor edge along a vertical surface and a horizontal surface of the floor.

3. The method of claim 2 wherein, during the step of hanging one or more façade panels, one or more strips of adjacently hung façade panels engage each other and thereby form a continuous strip of fire-safing insulation between the adjacently hung façade panels and the floor edge.

4. The method of claim 1 wherein, prior to the step of hanging, further comprising the step of securing the strip of fire-safing insulation to the one or more façade panels.

5. The method of claim 4 wherein the step of securing comprises the step of adhering the strip of fire-safing insulation to the one or more façade panels with a noncombustible adhesive.

6. The method of claim 1 further comprising the step of applying a noncombustible sealant between the shelf member and the horizontal surface of the floor.

7. The method of claim 1 wherein gaps are formed between shelf members of adjacently located façade panels and further comprising the step of sealing the gap with a noncombustible sealer and/or a noncombustible sealing strip.

8. The method of claim 1 wherein one or more panel position adjusting mechanisms operatively engage the shelf member and, during the step of hanging, further comprising the step of vertically and/or horizontally adjusting the position of the one or more façade panels relative to the floor.

9. The method of claim 1 wherein, during the step of hanging one or more façade panels, one or more strips of adjacently hung façade panels engage each other and thereby form a continuous strip of fire-safing insulation between the adjacently hung façade panels and the floor edge.

10. The method of claim 1 wherein, during the step of hanging one or more façade panels, one or more strips of adjacently hung façade panels engage each other and thereby form a continuous strip of fire-safing insulation between the adjacently hung façade panels and the floor edge.

11. The method of claim 1 further comprising, prior to or during the step of providing, wrapping the one of more of the façade panels and the strip of fire-safing insulation with a protective sheeting material and, prior to the step of hanging, removing the protective sheeting material from the one of more of the façade panels and the strip of fire-safing insulation.

12. A method of installing a façade on a building structure comprising a plurality of vertically stacked levels defined by horizontally arranged floors therebetween, the method comprising the steps of:

providing a plurality of façade panels, wherein one of more of the façade panels includes a strip of fire-safing insulation;

hanging the one or more façade panels on the one or more building floors adjacent an edge thereof;

wherein during the step of hanging, the façade panels and strip of fire-safing insulation are simultaneously traversed vertically downwardly and horizontally towards the floor edge thereby sandwiching and compressing at least a portion of the strip of fire-safing insulation between the one or more façade panels and the floor edge;

wherein, prior to the step of hanging, further comprising the step of securing the strip of fire-safing insulation to the one or more façade panels; and, wherein the step of securing comprises the steps of piercing the strip of fire-safing insulation with an impaling pin and attaching the impaling pin to the one or more façade panels.

13. The method of claim 12 wherein, during the step of attaching, a surface of the impaling pin is adhered to the one or more façade panels.

14. The method of claim 12 wherein, during the step of attaching, the impaling pin is fastened to the one or more façade panels with a fastener.

15. The method of claim 12 wherein, during the step of hanging, further comprising the steps of compressing at least a portion of the strip of fire-safing insulation and bending the impaling pin.

* * * * *